US008983322B2

(12) United States Patent
Sugimoto et al.

(10) Patent No.: US 8,983,322 B2
(45) Date of Patent: Mar. 17, 2015

(54) IMAGE FORMING APPARATUS

(75) Inventors: Naomi Sugimoto, Kanagawa (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 174 days.

(21) Appl. No.: 13/525,681

(22) Filed: Jun. 18, 2012

(65) Prior Publication Data

US 2012/0328314 A1 Dec. 27, 2012

(30) Foreign Application Priority Data

Jun. 22, 2011 (JP) ..... 2011-138035
Mar. 5, 2012 (JP) ..... 2012-048153

(51) Int. Cl.
*G03G 15/16* (2006.01)
*G03G 15/23* (2006.01)

(52) U.S. Cl.
CPC ..... *G03G 15/1605* (2013.01); *G03G 15/234* (2013.01); *G03G 15/1675* (2013.01)
USPC ..... 399/66; 399/121; 399/297; 399/314

(58) Field of Classification Search
USPC ..... 399/45, 66, 121, 297, 302, 308, 309, 399/314
See application file for complete search history.

(56) References Cited

U.S. PATENT DOCUMENTS 5,260,754 A 11/1993 Yano et al.
5,386,274 A 1/1995 Sanpe et al.
5,526,100 A 6/1996 Misago et al.
5,585,896 A 12/1996 Yamazaki et al.
5,592,267 A 1/1997 Misago et al.
5,678,129 A 10/1997 Yasuda et al.
5,749,022 A 5/1998 Kikui et al.
6,757,511 B2 6/2004 Sugimoto et al.
6,799,012 B2 9/2004 Shakuto et al.
6,823,163 B2 11/2004 Sugimoto et al.
6,987,944 B2 1/2006 Shakuto et al.
7,561,835 B2 7/2009 Tanaka et al.
7,653,339 B2 1/2010 Yamashita et al.
7,715,760 B2 5/2010 Sugimoto et al.
7,720,418 B2 5/2010 Tanaka et al.
7,728,503 B2 6/2010 Ohta et al.
7,738,819 B2 6/2010 Honda et al.

(Continued)

FOREIGN PATENT DOCUMENTS

JP 2008-58585 3/2008

*Primary Examiner* — David Gray
*Assistant Examiner* — Francis Gray
(74) *Attorney, Agent, or Firm* — Oblon, McClelland, Maier & Neustadt, L.L.P.

(57) ABSTRACT

An image forming apparatus including an image forming device, a transfer device, a fixing device, an inverting device, and a processor. The transfer device includes an intermediate transfer member, a nip forming member, and an electric potential difference generator to generate an electric potential difference between the intermediate transfer member and the nip forming member. The processor causes the electric potential difference generator to generate a first electric potential difference containing only a DC component when a toner image is transferred onto a first side of a recording sheet, and to generate a second electric potential difference containing a DC component and a superimposed AC component when the toner image is transferred onto a second side of the recording sheet. The second electric potential difference has an averaged absolute value per unit of time smaller than an absolute value of the first electric potential difference.

24 Claims, 10 Drawing Sheets

(56) References Cited

U.S. PATENT DOCUMENTS

| | | | | |
|---|---|---|---|---|
| 7,809,321 | B2 | 10/2010 | Yano et al. | |
| 7,817,954 | B2 | 10/2010 | Yano et al. | |
| 7,831,177 | B2 | 11/2010 | Someya et al. | |
| 7,873,298 | B2 | 1/2011 | Yamashita et al. | |
| 7,903,995 | B2 | 3/2011 | Nakamatsu et al. | |
| 7,929,897 | B2 | 4/2011 | Sugimoto et al. | |
| 7,941,087 | B2 | 5/2011 | Tanaka et al. | |
| 7,970,334 | B2 | 6/2011 | Yamashita et al. | |
| 7,979,017 | B2 | 7/2011 | Tanaka et al. | |
| 7,991,342 | B2 | 8/2011 | Kabata et al. | |
| 8,019,268 | B2 | 9/2011 | Nakamatsu et al. | |
| 8,041,281 | B2 | 10/2011 | Sugimoto et al. | |
| 8,080,096 | B2 | 12/2011 | Yamashita et al. | |
| 8,081,916 | B2 | 12/2011 | Tanaka et al. | |
| 8,081,917 | B2 | 12/2011 | Nakai et al. | |
| 8,086,141 | B2 | 12/2011 | Someya et al. | |
| 8,107,872 | B2 | 1/2012 | Ozaki et al. | |
| 8,190,077 | B2 | 5/2012 | Naruse et al. | |
| 2007/0212139 | A1 | 9/2007 | Sugiura et al. | |
| 2008/0260401 | A1* | 10/2008 | Shimazaki | 399/66 |
| 2008/0310897 | A1 | 12/2008 | Naruse et al. | |
| 2009/0035038 | A1 | 2/2009 | Sugimoto et al. | |
| 2009/0136270 | A1* | 5/2009 | Yamada | 399/308 |
| 2010/0008706 | A1 | 1/2010 | Sugiura et al. | |
| 2010/0034560 | A1 | 2/2010 | Tanaka et al. | |
| 2010/0054829 | A1 | 3/2010 | Iio et al. | |
| 2010/0183972 | A1 | 7/2010 | Hasegawa et al. | |
| 2010/0209143 | A1 | 8/2010 | Nakai et al. | |
| 2010/0232820 | A1* | 9/2010 | Usami et al. | 399/66 |
| 2010/0239302 | A1 | 9/2010 | Naruse et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0085834 | A1 | 4/2011 | Naruse et al. | |
| 2011/0103822 | A1 | 5/2011 | Sugiura et al. | |
| 2011/0158677 | A1 | 6/2011 | Kikuchi et al. | |
| 2011/0229187 | A1 | 9/2011 | Hozumi et al. | |
| 2011/0229234 | A1 | 9/2011 | Hozumi et al. | |
| 2012/0008973 | A1 | 1/2012 | Sakakibara et al. | |
| 2012/0045237 | A1* | 2/2012 | Aoki et al. | 399/66 |
| 2012/0045259 | A1* | 2/2012 | Nakamura et al. | 399/314 |
| 2012/0057912 | A1 | 3/2012 | Hasegawa et al. | |
| 2012/0060753 | A1 | 3/2012 | Tanaka et al. | |
| 2012/0063825 | A1 | 3/2012 | Hasegawa et al. | |
| 2012/0237234 | A1* | 9/2012 | Sugimoto et al. | 399/50 |
| 2012/0288290 | A1* | 11/2012 | Hano et al. | 399/49 |
| 2012/0328320 | A1* | 12/2012 | Fujita et al. | 399/88 |

* cited by examiner

※ LOW TEMPERATURE LOW HUMIDITY (10°C, 15%), Vpp=6kV, DUTY RATIO=50%

※ LOW TEMPERATURE LOW HUMIDITY (10°C, 15%), Vpp=6kV, DUTY RATIO=40%

※ LOW TEMPERATURE LOW HUMIDITY (10°C, 15%), Vpp=6kV, DUTY RATIO=32%

※ LOW TEMPERATURE LOW HUMIDITY (10°C, 15%), Vpp=7kV, DUTY RATIO=16%

※ LOW TEMPERATURE LOW HUMIDITY (10°C, 15%), Vpp=8kV, DUTY RATIO=8%

IMAGE FORMING APPARATUS

CROSS-REFERENCE TO RELATED APPLICATIONS

This patent application is based on and claims priority pursuant to 35 U.S.C. §119 to Japanese Patent Application Nos. 2011-138035, filed on Jun. 22, 2011 and 2012-048153, filed on Mar. 5, 2012 in the Japan Patent Office, the entire disclosures of which are hereby incorporated by reference herein.

BACKGROUND

1. Technical Field

The present disclosure relate to an image forming apparatus, such as a copier, a facsimile machine, a printer, or a multi-functional system including a combination thereof to perform duplex printing.

2. Description of the Related Art

Various image forming apparatuses using electrophotographic technology, in which a toner image is formed on a photoconductor, serving as an image carrier, are widely known. The photoconductor contacts a transfer roller, serving as a nip forming member, to form a transfer nip. By applying a transfer bias to the transfer roller, an electric potential difference that electrostatically moves the toner image on the photoconductor from the photoconductor side to the transfer roller side in the transfer nip is formed in the transfer nip between the photoconductor and the transfer roller.

In single-side printing mode, in which the toner image is formed on only one side of a recording sheet, initially, the recording sheet is sent to the transfer nip in a posture in which the first side of the recording sheet fed from a sheet-feed cassette closely contacts the photoconductor. Then, in the transfer nip, after the toner image is transferred onto the first side of the recording sheet, the recording sheet is transported to the fixing device where the toner image is fixed on the first side of a recording sheet. The recording sheet after passing through the fixing device is then discharged outside of the image forming apparatus.

By contrast, in duplex printing mode, the recording sheet after passing through the fixing device is turned upside down and is transported again to the transfer nip. Then, after the toner image is transferred onto a second side of the recording sheet, the toner image is fixed on the second side of the recording sheet in the fixing device.

In an image forming apparatus disclosed in US Pub 2008/0260401-A, in duplex printing mode, different transfer biases are used when the toner image is transferred onto the first side of the recording sheet and when the toner image is transferred onto the second side thereof. More specifically, when the toner image is transferred onto the first side, a direct-current (DC) bias constituted by only a direct current voltage is applied to the transfer roller as the transfer bias. By contrast, when the toner image is transferred onto the second side, a superimposed bias in which an alternating-current (AC) component is superimposed on a direct-current component is applied as the transfer bias.

With this configuration, deterioration of the photoconductor and the transfer roller caused by electrical discharge can be retarded by using only the DC bias as the transfer bias when the toner image is transferred onto the first side. This is because not a little electrical discharge is generated between the photoconductor and the transfer roller, which accelerates deterioration of the photoconductor and the transfer roller. When the superimposed bias containing the AC component is used as the transfer bias, compared to a case in which the DC bias is used, greater discharge is generated, which hastens the deterioration of the photoconductor and the transfer roller. Alternatively, by using only the DC bias as the transfer bias when the toner image is transferred onto the first side, the deterioration of the photoconductor and the transfer roller can be retarded, compared to the superimposed bias.

It is known that, by using the superimposed bias as the transfer bias instead of the DC bias when the toner image is transferred onto the second side, occurrence of image failure, such as white dots (white voids), toner scattering(fogging), and insufficient image density can be reduced. White dots are phenomena in which toner is partly absent in an image on which the toner should be transferred and the partly absent portion where the color comes out appears as white dots. Toner scattering is a phenomenon in which the toner is scattered and adhered around edges of the image.

The particular mechanism by which this reduction in image failure is accomplished is as follows: When the toner image is transferred onto the second side of the recording sheet, because the recording sheet passes through the fixing device in advance, water evaporates from the recording sheet due to heating in the fixing device. Compared to a state in which the toner image is transferred onto the first side of the recording sheet, the electrical resistance of the recording sheet is increased on transferring the toner image on the first side. Thus, as a transfer current flowing through the image of the recording sheet is decreased, a force to retain the toner in the image weakens, and as a result, the toner scattering and the insufficient image density may be easily generated.

If the value of the DC bias is set greater when the toner image is transferred onto the first side of the recording sheet in order to prevent the occurrence of toner scattering and insufficient image density, the white dots are easily generated, because, as the value of the DC bias is increased, the discharge becomes easily generated between the photoconductor and the transfer roller and facilitates movement (returning movement) of the toner reversely-charged by the discharge in the transfer nip from the image of the recording sheet to the photoconductor. It can be seen that there is thus an inverse relation (trade-off) between generation of the white dots, on the one hand, and toner scattering and insufficient image density on the other.

With the superimposed bias used instead of the DC bias, the trade-off remains but is attenuated because, while the AC electrical field formed between the photoconductor and the transfer roller causes the toner to reciprocally move back and forth between the photoconductor and the recording sheet in the transfer nip, the toner is relatively moved to a surface of the recording sheet. In this process, after the toner scattered around the image of the recording sheet is returned to the surface of the photoconductor, the toner is moved to the image, and as a result, the toner scattering around the image is less likely generated. In addition, when the toner adhering to the surface of the recording sheet is returned to the surface of the photoconductor, the returning toner hits the toner already present on the surface of the photoconductor and promotes separation of the toner from the surface of the photoconductor, which in turn promotes the movement of the toner from the surface of the photoconductor back to the surface of the recording sheet. As a result, the generation of the toner scattering and the insufficient image density are prevented using a smaller DC component, and the white dots are less likely to appear. Accordingly, the toner scattering, the insufficient image density, and the generation of white dots are prevented when the superimposed bias is used as the transfer bias, compared to when the DC bias is used.

However, even though the superimposed bias is used, depending on the exact value of the DC component, the generation of the white dots cannot be prevented sufficiently or the toner scattering and the insufficient image density cannot be prevented sufficiently. Therefore, the image forming apparatus in this example cannot reliably prevent the generation of the white dots, the toner scattering, and insufficient image density.

It is to be noted that, although the problem caused in a configuration in which the toner image is transferred on the recording sheet in the transfer nip formed between the photoconductor and the transfer roller is described above, alternatively, similar problem occur in the following configuration in the transfer nip formed between an image carrier, such as an intermediate transfer member that is different from the photoconductor, and a nip forming member (secondary transfer nip) that contacts the image carrier, and the toner image on the image carrier is transferred on the recording sheet.

SUMMARY

In one aspect of this disclosure, there is provided an improved image forming apparatus including an image forming device, a transfer device, a fixing device, an inverting device, and a processor. An image forming device to form a toner image. The transfer device includes an intermediate transfer member, a nip forming member, an electric potential difference generator. The intermediate transfer member has a surface to bear the toner image. The nip forming member presses against the intermediate transfer member to form a transfer nip between the intermediate transfer member and the nip forming member. The electric potential difference generator generates an electric potential difference between the intermediate transfer member and the nip forming member. The transfer device transfers the toner image on the surface of the intermediate transfer member to a recording sheet clamped in the transfer nip in a state in which the electric potential difference generator generates the electric potential difference between the intermediate transfer member and the nip forming member. The fixing device fixes the toner image on the recording sheet after the recording sheet is passed through the transfer nip. The inverting device inverts the recording sheet after the toner image is transferred and fixed onto a first side of the recording sheet upon passing through the transfer nip and the fixing device, and then transports the recording sheet to the transfer nip again. The processor causes the electric potential difference generator to generate a first electric potential difference containing only a direct current (DC) component when the toner image is transferred onto the first side of the recording sheet, and to generate a second electric potential difference containing a DC component and a superimposed alternating current (AC) component when the toner image is transferred onto a second side of the recording sheet. The second electric potential difference has an averaged absolute value per unit of time smaller than an absolute value of the first electric potential difference.

Another aspect of this disclosure, there is provided an improved image forming apparatus including, the image forming device, the transfer device, the fixing device, the inverting device, and a processor. The processor causes the electric potential difference generator to generate a first electric potential difference containing only a direct current (DC) component when the toner image is transferred onto the first side of the recording sheet, and a second electric potential difference containing either a DC component alone or a superimposed component in which an AC component is superimposed on a DC component when the toner image is transferred onto a second side of the recording sheet. The processor selectively switches the electric potential difference generator between a second DC electric potential difference containing the DC component alone and a second superimposed electric potential difference containing the superimposed component in which the AC component is superimposed on the DC component, as the second electric potential difference. The second superimposed electric potential difference has an averaged absolute value per unit of time smaller than an absolute value of the first electric potential difference.

Yet another aspect of this disclosure, there is provided an improved image forming apparatus including an image forming carrier, an electric potential difference generator, a transfer member, the fixing device, the inverting device, and the processor. The image forming carrier has a surface to form and bear a toner image. The electric potential difference generator generates an electric potential difference. The transfer member presses against the image forming carrier to form a transfer nip between the image forming carrier and the transfer member and transfers the toner image on the surface of the image forming carrier to a recording sheet clamped in the transfer nip in a state in which the electric potential difference generator generates the electric potential difference between the image forming carrier and the transfer member.

BRIEF DESCRIPTION OF THE DRAWINGS

The aforementioned and other aspects, features, and advantages will be better understood by reference to the following detailed description when considered in connection with the accompanying drawings, wherein.

DETAILED DESCRIPTION OF PREFERRED EMBODIMENTS

Figure 1:
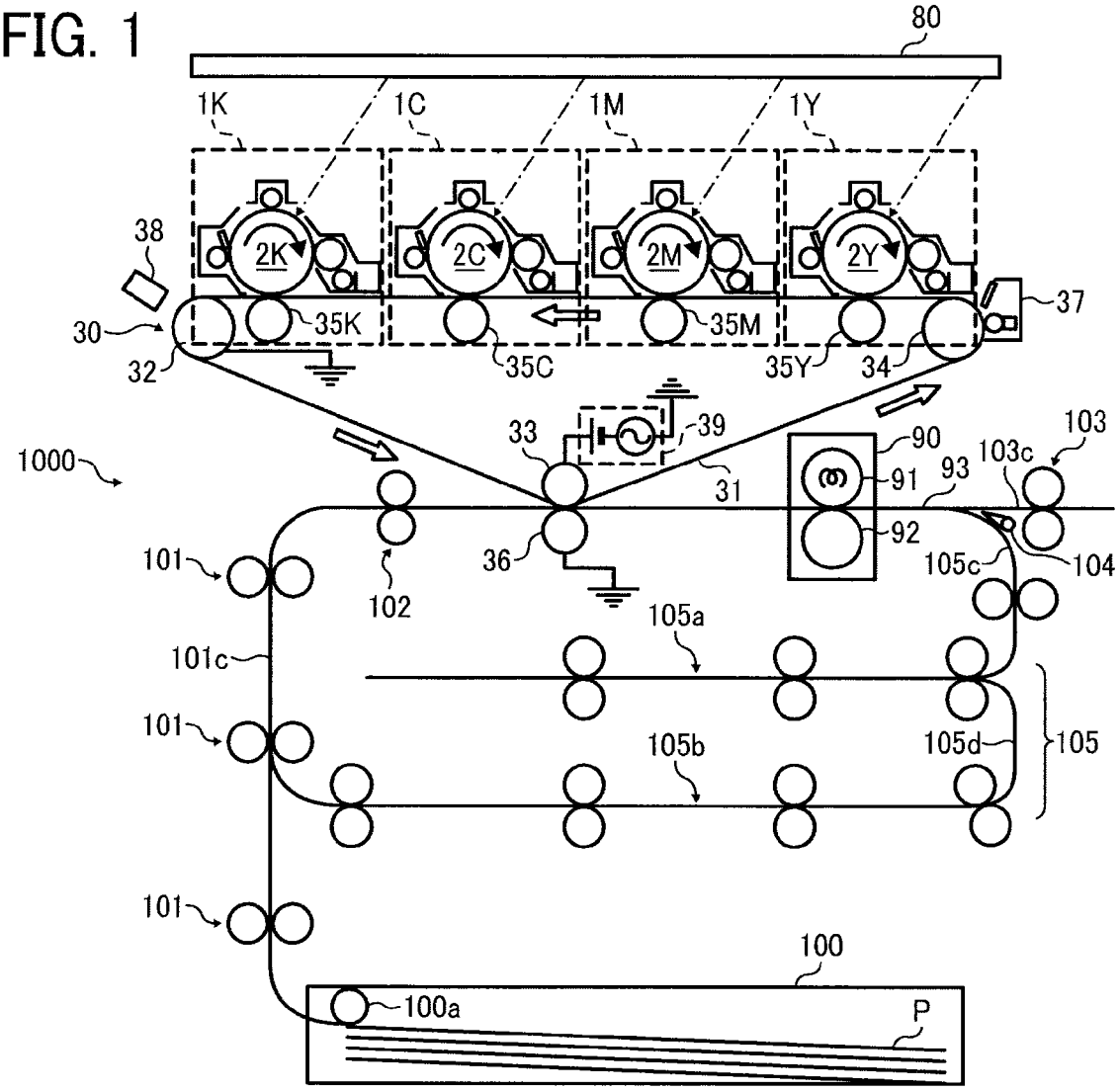
FIG. 1 is a schematic diagram illustrating an image forming apparatus according to the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 through 11, image forming apparatus according to illustrative embodiments are described. It is to be noted that although the image forming apparatus of the present embodiment is described as a printer, the image forming apparatus of the present invention is not limited thereto. In addition, it is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

(Configuration of Image Forming Apparatus)

FIG. 1 is a schematic diagram illustrating a color printer as an example of the image forming apparatus 1000 according to an illustrative embodiment of the present invention. As illustrated in FIG. 1, the image forming apparatus 1000 includes four image forming units 1Y, 1M, 1C, and 1K for forming toner images, one for each of the colors yellow, magenta, cyan, and black, respectively, a transfer unit 30, an optical writing unit 80, a fixing device 90, a sheet cassette 100, and a pair of registration rollers 102. The image forming apparatus 1000 includes an endless belt (intermediate transfer belt 31) as an intermediate transfer member. The four image forming units 1Y, 1M, 1C, and 1K for forming toner images are provided aligned to an upper portion of the intermediate transfer belt 31, which forms a tandem image forming unit.

It is to be noted that the suffixes Y, M, C, and K denote colors yellow, magenta, cyan, and black, respectively. To simplify the description, these suffixes Y, M, C, and K indicating colors are omitted herein, unless otherwise specified. The image forming units 1Y, 1M, 1C, and 1K all have the same configuration, differing only in the color of toner employed. Thus, a description is provided below of the image forming unit 1K for forming a toner image of black as a representative example of the image forming units 1. The image forming units 1Y, 1M, 1C, and 1K are replaceable, and are replaced upon reaching the end of their product life cycles.

Figure 2:
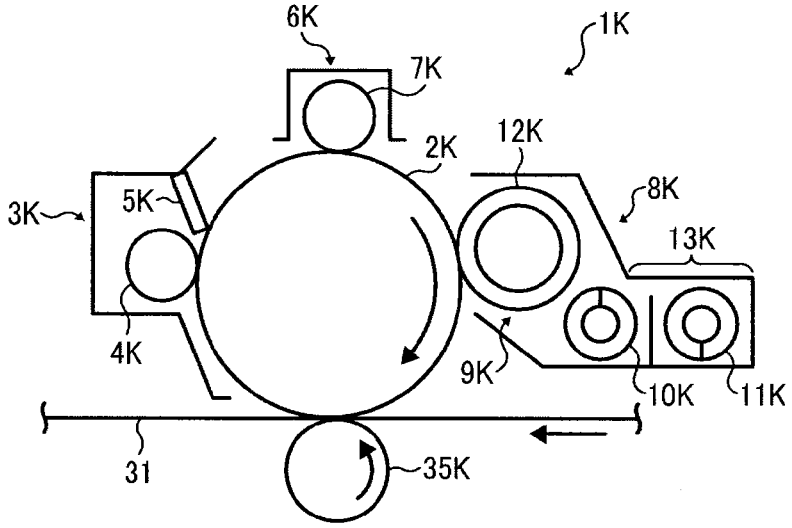
FIG. 2 is a schematic diagram illustrating an image forming unit included in the image forming apparatus shown in FIG. 1.

With reference to FIG. 2, a description is provided of the image forming unit 1K as an example of the image forming units 1. FIG. 2 is a schematic diagram illustrating the image forming unit 1K. A photoconductive drum (serving as photoconductor and photoreceptor) 2K serving as a latent image bearing member is surrounded by various pieces of imaging equipment, such as a charging device 6K, a developing device 8K, a drum cleaner 3K, and a charge neutralizing device (not illustrated). These devices are held by a common holder so that they are detachably attachable and replaced together at the same time.

The photoconductive drum 2K essentially consists of a drum-shaped base on which an organic photoconductive layer is disposed. The photoconductive drum 2K is rotated clockwise (indicated by arrow R1 in FIG. 2) by a driving device. The charging device 6K includes a charging roller 7K supplied with a charging bias. The charging roller 7K contacts or approaches the photoconductive drum 2 to generate an electrical field therebetween, thereby charging uniformly the surface of the photoconductive drum 2. According to the illustrative embodiment, the photoconductive drum 2 is uniformly charged to a negative polarity that is the same charging polarity as toner.

As the charging bias, an alternating current voltage superimposed on a direct current voltage is employed. The charging roller 7K comprises a metal rod (core metal) coated with a conductive elastic layer made of a conductive elastic material. Alternatively, a corona charger may be employed instead of the charging roller 7K.

The uniformly charged surface of the photoconductor drum 2K is scanned by laser beam from the optical writing unit 80, and bears the K electrostatic latent image. The electrical potential of the K electrostatic latent image is approximately −65 V. The K electrostatic latent image is developed to a K toner image by the development device 8K using black color toner. Then, the K toner color is transferred onto the intermediate transfer belt 31.

The developing device 8K includes a developer portion 12K including a developing roller 9K and a developer conveyance chamber 13K to agitate and convey the K developer. The developer conveyance chamber 13K includes a first conveyance chamber including a first screw conveyor 10K and a second conveyance chamber including a second screw conveyor 11K. Each of the screw conveyors 10K and 11K includes a rotary shaft rotatably supported by a bearing position in both ends in a shaft direction, and a spiral blade portion protruding outward from a circumferential surface of the rotary shaft.

The first conveyance chamber including the first screw conveyor 10K and the second conveyance chamber including the second screw conveyor 11K are divided by a partition. A penetration opening to communicate the first conveyance chamber and the second conveyance chamber is formed in both ends of the partition in the shaft direction. The first screw conveyor 10K conveys the developer from the back side toward the front side of the paper sheet on which FIG. 2 is drawn. The first screw conveyor 11K is disposed in parallel to the discharging roller 9K, the moving direction is same direction. The first screw conveyor 10K supplies the K developer to a surface of the developing roller 9K along the shaft direction.

The K developer transported to the front end of the first screw conveyor 10K passes through the penetration opening and enters the second transport chamber. In the second transport chamber, the K developer is held in the spiral blades of the second screw conveyor 11K. In conjunction with the rotation of the second screw conveyor 11K, the developer is agitated and transported toward the backside of the paper sheet on which FIG. 2 is drawn.

A toner concentration detector is provided on a lower wall of the casing of the second transport chamber to detect toner concentration in the K developer in the second transport chamber. The toner concentration sensor may be formed by a magnetic permeability sensor. Since, the magnetic permeability of the K developer has related to the toner concentration of K developer, the magnetic permeability sensor can detects the toner concentration of the K developer.

Although not illustrated, the image forming apparatus 1000 includes toner supply devices to independently supply toner of yellow, magenta, cyan, and black to the second chamber of the respective developing device 8. A controller of the image forming apparatus includes a Random Access Memory (RAM) to store a target output voltage Vtref for yellow, magenta, cyan, and black, provided by the toner concentration detector. If a difference between the output voltage provided by the toner concentration detectors and Vtref for each color exceeds a predetermined value, the toner supply devices are driven for a predetermined time period corresponding to the difference. Accordingly, the respective color of toner is supplied to the second chamber of the developing device 8.

The developing roller 9K in the developing portion 12K faces the first screw conveyor 10K and also the photoconductive drum 2K through an opening formed in the casing of the developing device 8K. The developing roller 9K comprises a developing sleeve made of a non-magnetic pipe that is rotated, and a magnetic roller disposed inside the developing sleeve such that the magnetic roller is fixed to prevent the magnetic roller from rotating together with the developing sleeve. The developing agent supplied from the first screw conveyor 10K is carried on the surface of the developing sleeve by the magnetic force of the magnetic roller. As the developing sleeve rotates, the developing agent is transported to a developing area facing the photoconductive drum 2K.

The developing sleeve is supplied with a developing bias having the same polarity as toner. The developing bias is greater than the bias of the electrostatic latent image on the photoconductive drum 2K, but less than the charging potential of the uniformly charged portion of the photoconductive drum 2K. With this configuration, a developing potential that causes the toner on the developing sleeve to move electrostatically to the electrostatic latent image on the photoconductive drum 2K is formed between the developing sleeve and the electrostatic latent image on the photoconductive drum 2K.

A non-developing potential acts between the developing sleeve and the non-image portion of the photoconductive drum 2K so that the toner on the developing sleeve to the sleeve surface. Due to the developing potential and the non-developing potential, the black toner on the developing sleeve moves selectively to the electrostatic latent image formed on the photoconductive drum 2K, thereby forming a visible image, known as a toner image of black. It is to be noted that although two-component developer including toner and carrier is used in the above-described embodiments, the development device 8K may contain only single-component developer consisting essentially of only toner.

The drum cleaner 3K includes a cleaning blade 5K and a brush roller 4K. The brush roller 4K rotates and brushes off the residual toner from the surface of the photoconductive drum 2K while the cleaning blade 5K removes the residual toner by scraping. The cleaning blade 5K is cantilevered, that is, one end of the cleaning blade is fixed to the housing of the drum cleaner 3K, and its free end contacts the surface of the photoconductive drum 2K. The brush roller 4K rotates and brushes off the residual toner from the surface of the photoconductive drum 2K while the cleaning blade 5K removes the residual toner by scraping. It is to be noted that the cantilevered side of the cleaning blade 5K is positioned downstream from its free end contacting the photoconductive drum 2K in the direction of rotation of the photoconductive drum 2K so that the free end of the cleaning blade 5K faces or becomes counter to the direction of rotation.

A charge neutralizer neutralizes any residual charge remaining on the photoconductive drum 2K after the surface thereof is cleaned by the drum cleaner 3K in preparation for the subsequent imaging cycle.

Similar to the image forming unit 1K, toner images of yellow, magenta, and cyan are formed on the photoconductive drums 2Y, 2M, and 2C of the image forming units 1Y, 1M, and 1C, respectively.

Referring again to FIG. 1, the optical writing unit 80 for writing a latent image on the photoconductive drums 2 is disposed above the image forming units 1Y, 1M, 1C, and 1K. Based on image information received from an external device such as a personal computer (PC), the optical writing unit 80 illuminates the photoconductive drums 2Y, 2M, 2C, and 2K with a light beam projected from a laser diode of the optical writing unit 80. Accordingly, the electrostatic latent images of yellow, magenta, cyan, and black are formed on the photoconductive drums 2Y, 2M, 2C, and 2K, respectively.

The optical writing unit 80 includes a polygon mirror rotated by a polygon motor, a plurality of optical lenses, and minors. The light beam projected from the laser diode serving as a light source is deflected in a main scanning direction by the polygon minor. The deflected light then strikes the optical lenses and mirrors, thereby scanning the photoconductive drum 2. The optical writing unit 80 may employ a light source using an LED array including a plurality of LEDs that project light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearer formed into an endless loop and rotated counterclockwise. The transfer unit 30 also includes a driving roller 32, a secondary-transfer rear roller 33, a cleaning backup roller 34, an nip forming roller 36, a belt cleaning device 37, an electric potential detector 38, four primary transfer rollers 35Y, 35M, 35C, and 35K, and so forth.

The intermediate transfer belt 31 is entrained around and stretched taut between the driving roller 32, the secondary-transfer rear roller 33, the cleaning backup roller 34, and the primary transfer rollers 35Y, 35M, 35C, and 35K (hereinafter collectively referred to as the primary transfer rollers 35, unless otherwise specified). The driving roller 32 is rotated counterclockwise by a motor or the like, and rotation of the driving roller 32 enables the intermediate transfer belt 31 to rotate in the same direction.

The intermediate transfer belt 31 of the present embodiment has a thickness in a range of from 20 μm to 200 μm, preferably approximately 60 μm. The volume resistivity thereof is in a range of from 6.0 log Ωcm to 13.0 log Ωcm, preferably approximately from 7.5 log Ωcm to 12.5 log Ωcm. The volume resistivity is measured with an applied voltage of 100V using a high resistivity meter, in this case a Hiresta UPMCPHT 45 manufactured by Mitsubishi Chemical Corporation. The surface resistivity of the intermediate transfer belt 31 is within 9.0 log Ωcm to 13.0 log Ω·cm, preferably 10.0 log $\Omega/cm^2$ to 12.0 log $\Omega/cm^2$. The surface resistivity is measured with an applied voltage of 500V for 10 milli-seconds, using a high resistivity meter, in this case a Hiresta UPMCPHT 45 manufactured by Mitsubishi Chemical Corporation.

The intermediate transfer belt 31 is interposed between the photoconductive drums 2 and the primary transfer rollers 35. Accordingly, a primary transfer nip is formed between the outer surface of the intermediate transfer belt 31 and the photoconductive drums 2. The primary transfer rollers 35 are supplied with a primary bias by a transfer bias power source, thereby generating a transfer electric field between the toner images on the photoconductive drums 2 and the primary transfer rollers 35.

The toner image Y of yellow formed on the photoconductive drum 2Y enters the primary transfer nip as the photoconductive drum 2Y rotates. Subsequently, the toner image Y is transferred from the photoconductive drum 2Y onto the intermediate transfer belt 31 by the transfer electrical field and the nip pressure. As the intermediate transfer belt 31 on which the toner image of yellow is transferred passes through the primary transfer nips of magenta, cyan, and black, the toner images on the photoconductive drums 2M, 2C, and 2K are superimposed on the toner image Y of yellow, thereby forming a composite toner image on the intermediate transfer belt 31 in the primary transfer process.

In the case of monochrome imaging, a support plate supporting the primary transfer rollers 35Y, 35M, and 35C of the transfer unit 30 is moved to separate the primary transfer rollers 35Y, 35M, and 35C from the photoconductive drums 2Y, 2M, and 2C. Accordingly, the outer surface of the intermediate transfer belt 31, that is, the image bearing surface, is separated from the photoconductive drums 2Y, 2M, and 2C, so that the intermediate transfer belt 31 contacts only the photoconductive drum 2K. In this state, the image forming unit 1K is activated to form a black toner image on the photoconductive drum 2K.

In the present embodiment, each of the primary transfer rollers 35 is constituted of an elastic roller including a metal rod on which a conductive sponge layer is provided. The total external diameter thereof is approximately 16 mm. The diameter of the metal rod alone is approximately 10 mm. The resistance of the sponge roller is in a range from 1E7Ω to 3E7Ω. The resistance is detected while 5 N weight is applied to one side, a 1 [kV] load of a metal roller having 30 mm external diameter connected to the ground is applied to a rotary shaft (metal rod) of the primary transfer roller 35, and the roller 35 is rotated one for 1 minute, and the detected average value is set as the volume resistivity thereof. The resistance is obtained by Ohm's law, R=V/I, where V is voltage, I is current, and R is resistance.

The primary transfer rollers 35 described above are supplied with a primary transfer bias under constant current control. According to this embodiment, a roller-type primary transfer device is used as the primary transfer roller 35. Alternatively, a transfer charger, a brush-type transfer device, and so forth may be employed as a primary transfer device (see FIG. 19).

The nip forming roller 36 of the transfer unit 30 is disposed outside the loop formed by the intermediate transfer belt 31, opposite the secondary-transfer rear roller 33. The intermediate transfer belt 31 is interposed between the secondary-transfer rear roller 33 and the nip forming roller 36, thereby forming a secondary transfer nip between the outer surface of intermediate transfer belt 31 and the nip forming roller 36. The nip forming roller 36 is electrically grounded. The secondary-transfer rear roller 33 is supplied with a secondary transfer bias from a secondary transfer bias power supply 39.

With this configuration, a secondary transfer electric field is formed between the secondary-transfer rear roller 33 and the nip forming roller 36 so that the toner of negative polarity is transferred electrostatically from the secondary-transfer rear roller 33 side to the nip forming roller 36 side.

The sheet cassette 100 storing a stack of recording media sheets is disposed beneath the transfer unit 30. The sheet cassette 100 is equipped with a sheet feed roller 101 to contact a top sheet of the stack of recording media sheets. At an end of a sheet passage 101*c*, the pair of registration rollers 102 is disposed. As the sheet feed roller 101 is rotated at a predetermined speed, the sheet feed roller 101 picks up the top sheet of the recording medium P and sends it to the sheet passage 101*c*. Then, the pair of registration rollers 102 stops rotating temporarily as soon as the recording medium P is interposed therebetween. The pair of registration rollers 102 starts to rotate again to feed the recording medium P to the secondary transfer nip in appropriate timing such that the recording medium P is aligned with the composite toner image formed on the intermediate transfer belt 31 in the secondary transfer nip.

In the secondary transfer nip, the recording medium P tightly contacts the composite toner image on the intermediate transfer belt 31, and the composite toner image is transferred onto the recording medium P by the secondary transfer electric field and the nip pressure applied thereto. The recording medium P on which the composite color toner image is formed passes through the secondary transfer nip and separates from the nip forming roller 36 and the intermediate transfer belt 31 by self striping.

The secondary-transfer rear roller 33 is formed by a metal rod on which conductive foam elastic is provided. By contrast, the nip forming roller 36 is formed by a metal rod on which a conductive nitride rubber (NBR) is provided. Alternatively, the secondary-transfer rear roller 33 is formed by a metal rod on which conductive NBR is provided, and the nip forming roller 36 is formed by a metal rod on which a conductive foam elastic is provided The outer diameter of the secondary-transfer rear roller 33 is approximately 24 mm. The diameter of the cored bar is approximately 16 mm. The resistance R of the conductive foam layer is in a range of from 1e6Ω to 2e7Ω. The resistance R is measured using the same method as the primary transfer roller 35 described above. The resistance R of the secondary transfer rear roller 33 is in a range of from 1e6Ω to 1e12Ω, preferably, approximately 4e7Ω. Alternatively, the secondary transfer rear roller 33 may be formed by a stainless steel roller, without providing the conductive form layer. The resistance R of the secondary transfer rear roller 33 is measured such that, 5 N weight is applied to both side of the shaft in a longitudinal direction, a 1 [kV] load is applied to a rotary shaft (metal rod) of the secondary transfer rear roller 33, and the secondary transfer rear roller 33 is rotated one for 1 minute, and the detected average value is set as the volume resistivity thereof.

The outer diameter of the nip forming roller 36 is approximately 24 mm. The diameter of the metal cored bar is approximately 14 mm. The resistance R of the conductive NBR rubber layer is equal to or less than 1e6Ω. The resistance R of the nip forming roller 36 is in a range of from 6.0 log Ω to 8.0 log Ω, preferably, approximately from 7.0 log Ω to 8.0 log Ω. The resistance R is measured using the same method as the secondary transfer rear roller 33 described above.

The electric potential sensor 38 is provided inside the loop of the intermediate transfer belt 31, facing the loop of the intermediate transfer belt 31 around which the driving roller 32 is wound, and facing 4 mm gap. Then, when the toner image transferred onto the intermediate transfer belt 31 enters the portion facing the electric potential sensor 38, the electric potential sensor 38 measures the electric potential of the surface thereof. Herein, EFS-22D, manufacture by TDK company, is used as the electric potential sensor 38.

The secondary transfer bias power supply 39 includes a direct-current (DC) voltage source and an alternating-current (AC) voltage source and outputs a DC bias containing only the DC voltage and a superimposed bias in which the AC bias is superimposed on the DC voltage. An output terminal of the secondary transfer bias power supply 39 is connected to the metal rod of the nip forming roller 36. The electric potential of the metal rod of the nip forming roller 36 is set equal to the output voltage from the secondary transfer bias power supply 39. The metal rod of the secondary transfer rear roller 33 is connected to ground (i.e., is electrically grounded).

In FIG. 1, the secondary transfer bias is applied to the metal rod of the secondary transfer rear roller (facing member) 33 and the metal rod of the nip forming roller 36 is electrically grounded. Alternatively, the superimposed bias may be applied to the metal rod of the nip forming roller 36, while the metal rod of the secondary transfer rear roller 33 is electrically grounded More specifically, when the superimposed bias is applied to the metal rod of the secondary transfer rear roller 33 and the metal rod of the nip forming roller 36 is electrically grounded, a secondary transfer bias is set to a negative polarity identical to the toner charging polarity and the time-averaged electrical potential of the superimposed bias is set to the negative polarity identical to the toner charging polarity.

By contrast, when the superimposed bias is applied to the metal rod of the nip forming roller 36 and the metal rod of the secondary transfer rear roller 33 is electrically grounded, a secondary transfer bias is set to a positive polarity opposed to the toner charging polarity and the time-averaged electrical potential of the superimposed bias is set to the positive polarity opposed to the toner charging polarity.

Alternatively, instead of the configuration in which the superimposed bias applied to either the nip forming roller 36 or the secondary transfer rear roller 33, the DC voltage may be applied to one of the rollers 33 and 36 and the AC voltage may be applied to the other of the rollers 36 and 33. It is to be noted that although in the present embodiment a rectangular waveform is used as the alternating voltage in the present embodiment, alternatively, a sine wave or other wave forms may be used as the alternating current voltage (see FIGS. 4, 9, and 14 through 17).

After the intermediate transfer belt 31 passes through the secondary transfer nip, a certain amount of transfer residual adhered toner remains on the intermediate transfer belt 31. The residual toner adhering to the outer surface of the intermediate transfer belt 31 is removed by a belt-cleaning device 37 that contacts the outer surface of the intermediate transfer belt 31. The cleaning backup roller 34 positioned inside loop of the intermediate transfer belt 31 backs up (supports) the cleaning of the belt-cleaning device 37 to the intermediate transfer belt 31 from the inside loop thereof.

On the right side of the secondary transfer nip formed between the secondary-transfer rear roller 33 and the intermediate transfer belt 31, the fixing device 90 is disposed. The fixing device 90 includes a fixing roller 91 and a pressing roller 92. The fixing roller 91 includes a heat source such as a halogen lamp inside thereof. While rotating, the pressing roller 92 presses against the fixing roller 91, thereby forming a heated area called a fixing nip with the intermediate transfer belt 31 interposed therebetween. The recording medium P bearing an unfixed toner image on the surface thereof is conveyed to the fixing device 90 and into the fixing nip between the fixing roller 91 and the pressing roller 92 in the fixing device 90. Under heat and pressure in the fixing nip, the toner adhering to the toner image is softened and fixed to the recording medium P.

The recording sheet P that is discharged from the fixing device 90 is conveyed to a switching pawl 104*a* that pivots around a shaft is provided in a lateral side of an after-fixing transport path 93. The switching pawl 104*a* switches the transport path of the recording sheet P between a sheet discharge path 103*c* and a reverse conveyance path 105*c*. In a state shown in FIG. 1, the switching pawl 104 guides the recording sheet P to the sheet discharge path 103*c*. In this state, the recording medium P is discharged outside the image forming apparatus 1000 along the sheet discharge path 103*c* via a discharge roller pair 103.

In the image forming apparatus 100, the sheet-reverse device 105 is provided between the transfer unit 30 and the sheet cassette 100. The sheet-reverse device 105 includes a switch back portion 105*a* and a resending portion 105*b*. When the duplex printing mode is set, the switching pawl 104 connects the sheet transport path 93 to the reverse conveyance path 105*c* to guide the recording sheet P to the reverse conveyance path 105*c*. The recording sheet P is turned upside down along a large curved reverse conveyance path 105*c* and transported to the switch back portion 105*a*. When the entire recording sheet P is entered in the switch back portion 105*a*, multiple switch back rollers in the switch back portion 105*a* starts reversely rotating to cause the recording sheet to switch back. Thus, while a trailing edge of the recording sheet P is lower portion, the recording sheet P is turned upside down along the large curved reverse conveyance path 105*c* and transported to the resending portion 105*b* positioned beneath the switch back portion 105*a*. Then, the resending portion 105*a* transports again the recording sheet P to the transport path 103. Subsequently, while the recording sheet P is passes through the registration rollers 102 and the secondary transfer nip N, the second side of the recording sheet P is transferred. Then, the second side of the recording sheet P is fixed in the fixing device 90.

By contrast, when single-side printing is set, the switching pawl 104 connects the transport path 93 to the sheet discharge path 103*c*. By this setting, the recording medium P after the toner image is transferred and fixed on only the first side is discharged outside the image forming apparatus 1000 along the sheet discharge path 103*c* via a discharge roller pair 103. In the duplex printing, when the toner image is fixed on the second side of the recording sheet P after the transfer process in the second side, the switching pawl 104 switches from the reverse conveyance path 105*c* to the sheet discharge path 103*c*. Then, the recording medium P after the toner image is fixed on both sides is discharged outside the image forming apparatus 1000 along the sheet discharge path 103*c* via the discharge roller pair 103.

In this image forming apparatus 1000, the process linear speed (linear velocity) is set to 352 mm/s, in normal mode. Alternatively, in high image-quality mode, in which the image quality is given priority to the printing speed, the linear velocity is set slower than 352 mms. Yet alternatively, in high-speed mode, in which the printing speed is given priority to the image quality, the process linear velocity is set faster than 352 mm. The normal mode, high image-quality mode, the high speed mode are switched by inputting key on the control panel by the user, or by selecting property menu in the personal computer.

In the above-configured image forming apparatus 1000, the intermediate transfer belt 31 serves as an intermediate transfer member. The combination of respective colors of image forming units 1Y, 1M, 1C, and 1K, the optical writing unit 80, and the transfer unit 30 serves as an image forming device to form the image on the surface of the intermediate transfer member (intermediate transfer belt 31). The secondary transfer rear roller 33 serves as a facing member, and the nip forming roller 36 serve as a nip forming member. The transfer unit 30 mainly including the intermediate transfer member 31, the nip forming member 36, the facing member 33, and the electric potential difference generator 39 functions as a transfer device. An inverting device is constituted by a switching pawl 104 and a sheet-reverse device 105. A controller 200 serves as a processor to drive and the control the image forming device and the transfer device.

Figure 3:
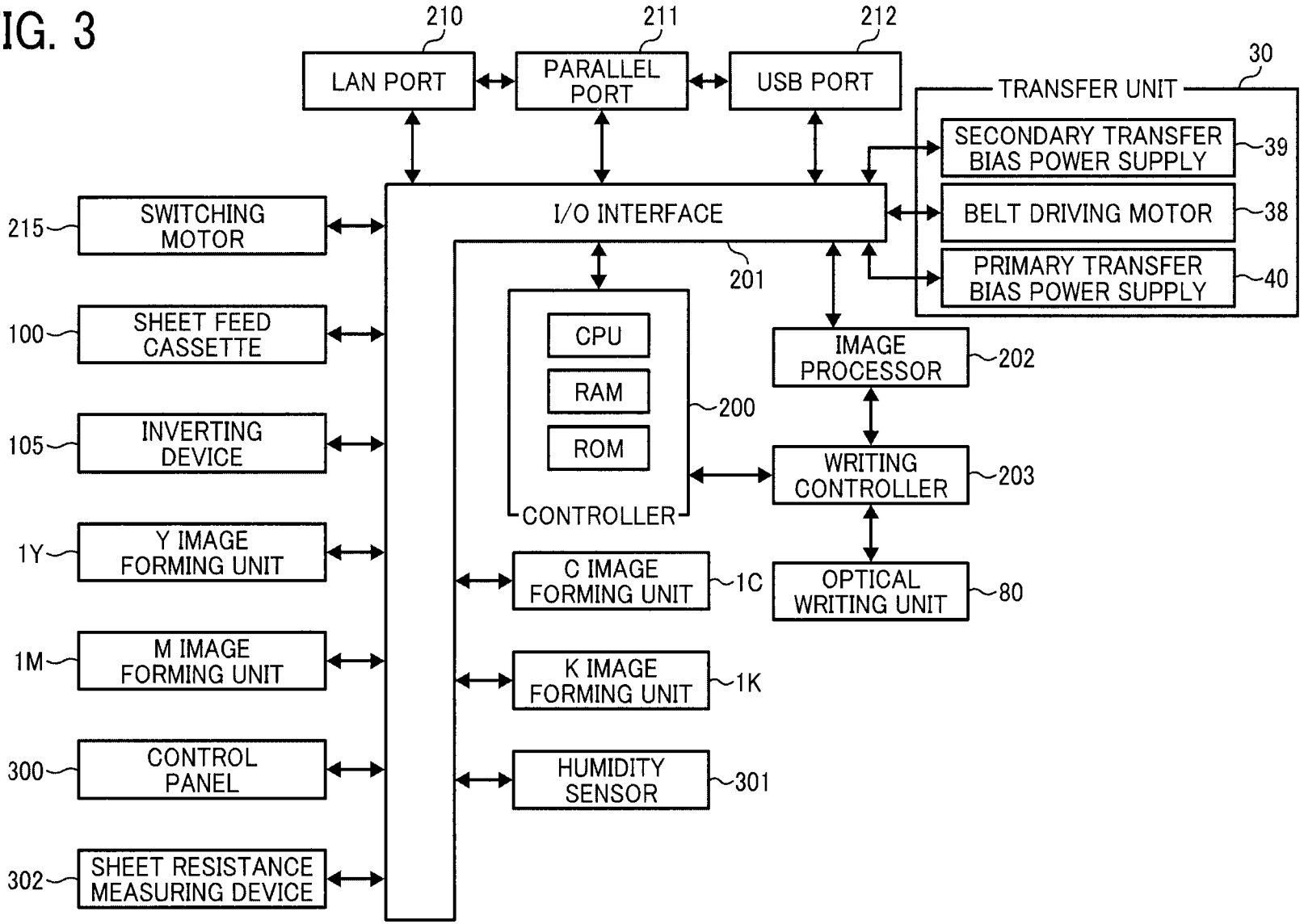
FIG. 3 is a block diagram illustrating electrical circuitry of a part of the image forming apparatus shown in FIG. 1.

FIG. 3 is a block diagram illustrating electrical circuitry of a part of the image forming apparatus 1000. In FIG. 3, the controller 200 includes a Central Processing Unit (CPU), a Random Access Memory (RAM), and a Read Only Memory (ROM), which handles various types of arithmetic processing and executes control programs. The controller 200 is connected to a local area net work (LAN) port 210, a parallel port 211, a universal serial bus (USB) port 212, the transfer unit 30, an image processor 202, a switching motor 215, a sheet feeding cassette 100, the sheet-reverse device 105, the image forming units 1Y, 1M, 1C, and 1K, the control panel 300, a humidity sensor 301, and a sheet resistance measuring device 302 via an input-output (I/O) interface 201. The switching motor 215 drives the switching pawl 104 (see FIG. 1). The image processor 202 processes the image data sent from external personal computers.

The image data processed in the image processor 202 is transmitted to a writing controller 203. The writing controller 203 controls the driving of the optical writing unit 80 based on the transmitted image data so that the optical writing unit 80 scans the respective photoreceptors 2Y, 2M, 2C, and 2K. The control panel 300, the humidity sensor 301, and the sheet resistance measuring device 302 are described in further detail later.

When the toner image is secondary transferred onto a first surface of the recording sheet in the duplex printing mode or the single-side printing mode, the controller 20 outputs a first-side transfer signal to the secondary transfer bias power supply 39 in the transfer unit 30. By contrast, when the toner image is secondary transferred onto a second side of the recording sheet in the duplex printing mode, the controller 200 outputs a second-side transfer signal to the secondary transfer bias power supply 39.

While receiving the first-side transfer signal from the controller 200, the secondary transfer bias power supply 39 outputs a DC bias constituted by only direct-current voltage as the secondary transfer bias. With this operation, compared to a case in which the superimposed bias in which the alternating-current (AC) voltage is superimposed on the DC voltage, the occurrence of electrical discharge between the secondary transfer rear roller 33 and the intermediate transfer belt 31 and between the intermediate transfer belt 31 and the nip forming roller 36 can be prevented Therefore, deterioration of the secondary transfer rear roller 33, the intermediate transfer belt 31, and the nip forming roller caused by the electrical discharge can be retarded.

By contrast, while receiving the second-side transfer signal from the controller 200, the secondary transfer bias power supply 39 outputs the superimposed bias in which the AC voltage is superimposed on the DC voltage as the secondary transfer bias. With this operation, compared to the case in which the DC bias is output, generation of the white dots in which the toner is not covered and toner scattering can be prevented.

Figure 4:
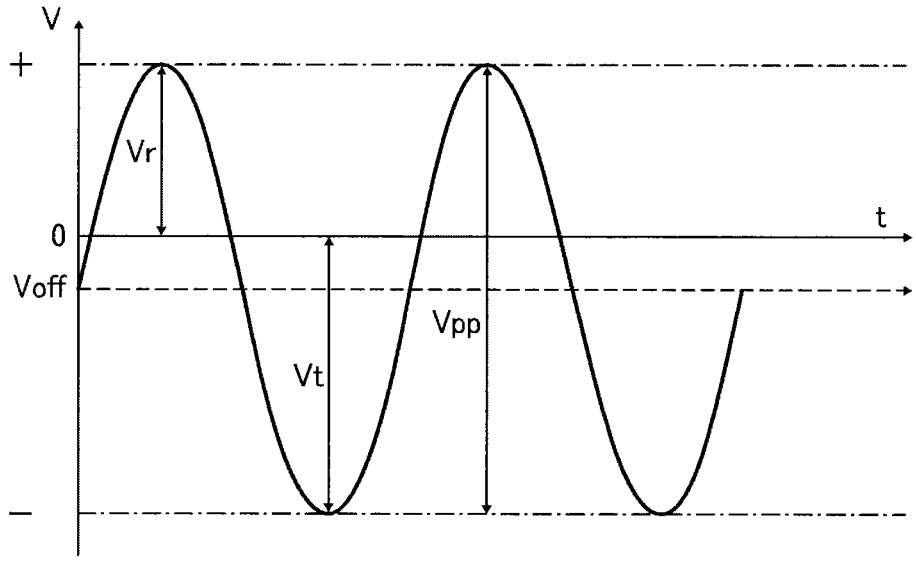
FIG. 4 is a waveform diagram illustrating a sine wave of a superimposed bias output from a secondary transfer bias power supply shown in FIG. 1.

FIG. 4 is a waveform diagram illustrating a waveform of the superimposed bias output from the secondary transfer bias supply 39. In FIG. 4, an offset voltage Voff is a value of a direct current (DC) component of the superimposed bias. A peak-to-peak voltage Vpp is a peak-to-peak voltage of an alternating current (AC) component of the superimposed bias. The superimposed bias is a value in which the peak-to-peak voltage Vpp is superimposed on the offset voltage Voff.

In FIG. 4, the superimposed bias is a sine wave, having a positive peak and a negative peak. The negative peak is indicated by a value Vt, corresponding to a position at which the toner is moved from the belt side to the recording medium, in the secondary transfer nip. The positive peak is represented by a value Vr, corresponding to a position direction in which the toner is returned to the belt side (plus side). The area under the weave form on the positive side is identical to that of the negative side, such that an averaged electric potential difference in a single cycle is 0 V.

When the superimposed bias has a positive polarity opposed to that of the toner, a returning electrical field to return the toner image from the recording sheet side to the intermediate transfer side is formed between the secondary transfer rear roller 33 and the nip forming roller 36. When the positive peak value Vr appears, the returning electrical field reaches its maximum.

By contrast, when the superimposed bias has a negative polarity identical to that of the toner, a transfer electrical field to move the toner image from the intermediate transfer side to the recording sheet side is formed between the secondary transfer rear roller 33 and the nip forming roller 36. When the positive peak value Vt appears, the transfer electrical field reaches its maximum.

Instead of the superimposed bias shown in FIG. 4, when the AC bias constituted by only AC voltage is applied, the toner can be reciprocally moved in the secondary transfer nip between the belt and the recording sheet. However, with only an AC bias, although the toner is simply reciprocally moved, the toner cannot be transferred onto the recording sheet.

By applying the superimposed bias containing the DC component, and setting a time-averaged voltage Vave [V] of the superimposed bias to the negative polarity that is equal to the toner polarity, the toner can be moved from the belt side to the recording sheet side while the toner is reciprocally moved therebetween.

Next, experiments conducted by the inventors are described below.

[Experiment 1]

The inventors prepared a printer having the same configuration as that of the above-described image forming apparatus 1000. The inventors carried out various types of print tests using the printer. In the experiment 1, the process linear velocity is set to 352 [mm/s]. As the recording sheet P, A4 sized paper (wood-free paper, My Paper manufactured by NBS Ricoh) is used.

In the experiment 1, the single magenta color solid image is formed on the respective first side and the second side of recording medium in the duplex printing mode, under normal experimental laboratory conditions (temperature 23° C. and humidity 50%). At this time, as the DC bias is applied as the transfer bias to both the first side and the second side, the DC bias is gradually increased in a range of from −1 [kV] to −6 [kV] in 0.1 [kV] increments, and the duplex print is performed at the respective voltage values. Then, the magenta single color solid image formed on the second side of the recording sheet P is graded in accordance with the toner scattering around the solid image and white dots in the solid image.

The toner scattering was evaluated as follows:

Grade 5 (best grade): A situation in which no toner scattering around the solid image was observed when viewed with the naked eye.

Grade 4: A situation in which the toner scattering around the solid image was visible when looked for carefully and was hardly noticeable if not looked for carefully. Grade 4 is next to grade 5.

Grade 3: A situation in which approximately 1 mm width of the toner scattering around the solid image was visible when viewed with the naked eye. Grade 3 is next to grade 4.

Grade 2: A situation in which the toner scattering around the solid image was worse than the grade 3 but better than the grade 1.

Grade 1(Worst grade): A situation in which over 2 mm width of the toner scattering around the solid image was visible when viewed with the naked eye The grades 4 and 5 can be considered high image quality.

The white dots were evaluated as follows:

Grade 5 (best grade): A situation in which no white dots in the solid image was observed when viewed with the naked eye.

Grade 4: A situation in which the white dots in the solid image were visible when looked carefully and was hardly noticeable if not looked carefully (grade 4 is next to grade 5).

Grade 3: A situation in which the white dots in the solid image was visible when viewed with the naked eye without looking carefully, that is, the situation slightly exceeds an acceptable range as the high image quality Grade 2: A situation in which the white dots in the solid image was worse than the grade 3.

Grade 1 (worst grade): A situation in which white dots in the solid image was visible at the first glance and the white dots occurs in entire solid image.

In the experiment 1, under conditions in which the DC bias is set to approximately −4 [kV], the generation of both toner scattering around the solid image and white dots in the solid image can be kept within the acceptable range (grade 4 or 5).

[Experiment 2]

The toner scattering around the solid image and white dots in the solid image were evaluated under conditions of low temperature and low humidity (temperature: 10° C., humidity: 15%).

Figure 5:
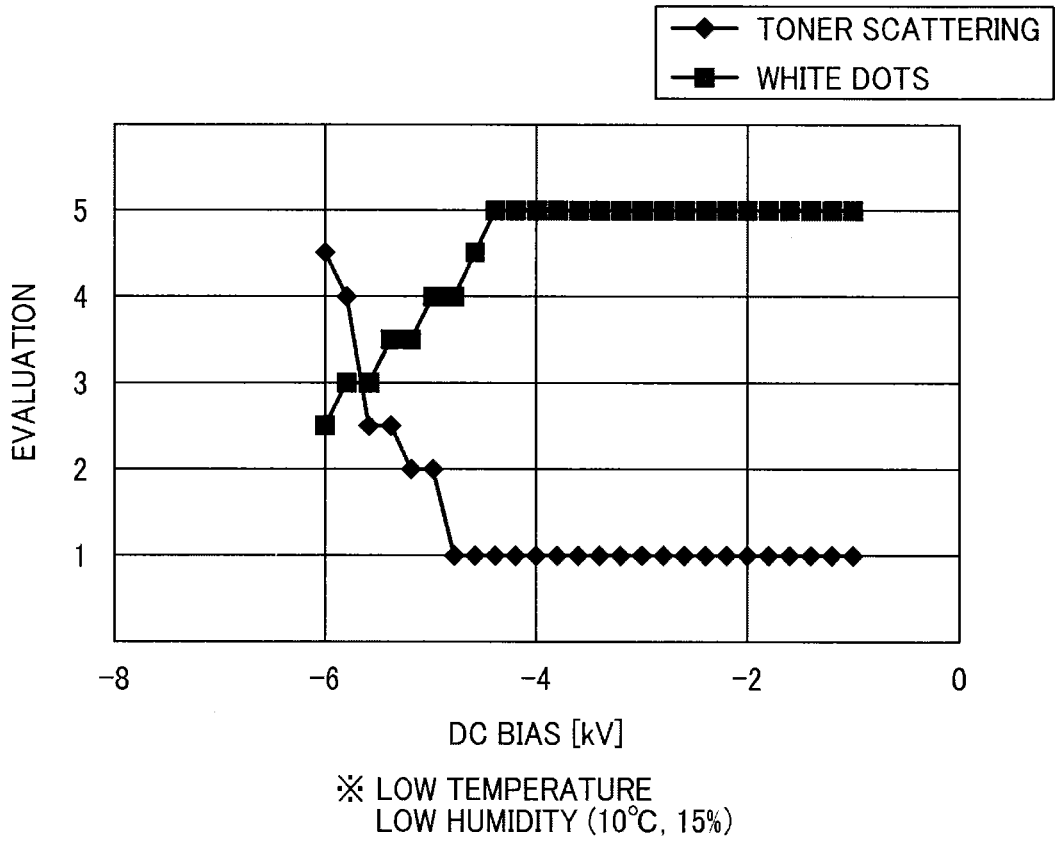
FIG. 5 is a graph illustrating a relation between the DC voltage of the secondary transfer bias and evaluations of the white dots and the toner scattering, obtained from experiment 2.

FIG. 5 illustrates the result in the experiment 2. More specifically, FIG. 5 illustrates the relation between the voltage of the secondary transfer bias and the evaluation grade of the white dots and the toner scattering, obtained from the experiment 2. As illustrated in FIG. 5, if focusing on only the toner scattering, by setting the DC bias (absolute value) less than −4.2 [kV], the toner scattering can be evaluated as an acceptable level of grade 4 or 5.

By contrast, if focusing on only the white dots, by setting the DC bias (absolute value) greater than −5.9 [kV], the white dots can be evaluated as an acceptable level of grade 4 or 5.

However, the voltage value that fulfills both toner scattering and the white dots over grade 4 does not exist. This is because, at low temperature and low humidity, as the water evaporates from the recording sheet P when the first side is fixed, an electrical resistance of the recording sheet P is excessively increased and the transfer current in the image in the recording sheet P flows less freely. As a result, when the DC bias value is increased to a level that the toner scattering is within the acceptable level, the electrical potential becomes excessive and begins to generate the white dots caused by the electrical discharge beyond the acceptable level.

By contrast, the white dots and the toner scattering on the first side can be kept within the acceptable range (grade 4 or 5) under conditions in which the DC bias value is within a range of −4.8 [kV] to −6.6 [kV]. Accordingly, in the first side, even under conditions of low temperature and low humidity, the white dots and the toner scattering can be kept within the acceptable range (grade 4 or 5) by applying the DC bias as the transfer bias.

[Experiment 3]

In the experiment 3, the process linear velocity is set to 352 [mm/s]. As the recording sheet P, A4 sized paper (wood-free paper, My Paper manufactured by NBS Ricoh) is used. The single magenta color solid image is formed on the respective first side and the second side of recording medium in the duplex printing mode, under the ambient in the experimental laboratory is set under conditions of low temperature and low humidity (temperature: 10° C., humidity: 15%)

As for the power supply 39 to generate a voltage, a function generator (FG300 Yokogawa Electric Corporation) is used to create a waveform, and the voltage is amplified by a factor of 1000 by an amplifier (Trek High Voltage Amplifier Model 10/40). As the transfer bias, a superimposed bias in which the AC voltage whose frequency is 500 [Hz] and the peak-to-peak voltage Vpp is 6 [kV] is superimposed on the offset voltage Voff as the DC voltage is used. The superimposed is gradually increased in a range of from −0.6 [kV] to −4.6 [kV] in 0.4 [kV] increments, and the duplex print is performed at the respective voltage values. Then, the magenta single color solid image formed on the second side of the recording sheet P is graded in accordance with the toner scattering around the solid image, white dots in the solid image, and an image density in the solid image.

The image density ID was measured by an X-Rite93 manufactured by X-Rite. The image density ID of 1.4 or more can be considered high image quality.

As for the waveform of the AC voltage, sine wave was used. In the sine wave, a duty ratio in a direction in which the toner is returned to the belt (hereinafter "toner returning direction") is 50%. The duty ratio in the toner returning direction is a ratio area surrounded by a wave on the toner retuning side relative to an entire ratio, setting a centerline of the peak-to-peak of the AC voltage as a border.

The toner returning side is on the side to the toner is returned from the surface of the recording sheet P to the intermediate transfer belt 33 side (in positive value and negative value). In the image forming apparatus according to the printer experimental equipment and the above-described embodiment, when the polarity of the AC voltage is set to a positive polarity, the toner is returned from the recording sheet P to the intermediate transfer belt 31. Therefore, by setting the central line of the peak-to-peak of the AC voltage as the border, the area surrounded by the positive polarity side and the centerline of the wave functions as the area in the toner retuning direction.

By contrast, by using this border, the area surrounded by the negative polarity side and the center line of the wave functions as the area in the toner sending direction (toner transfer direction). In case of the sine wave, the area in the toner returning side is equal to the area in the toner sending side, the duty ratio in the toner returning side is 50%.

Figure 6:
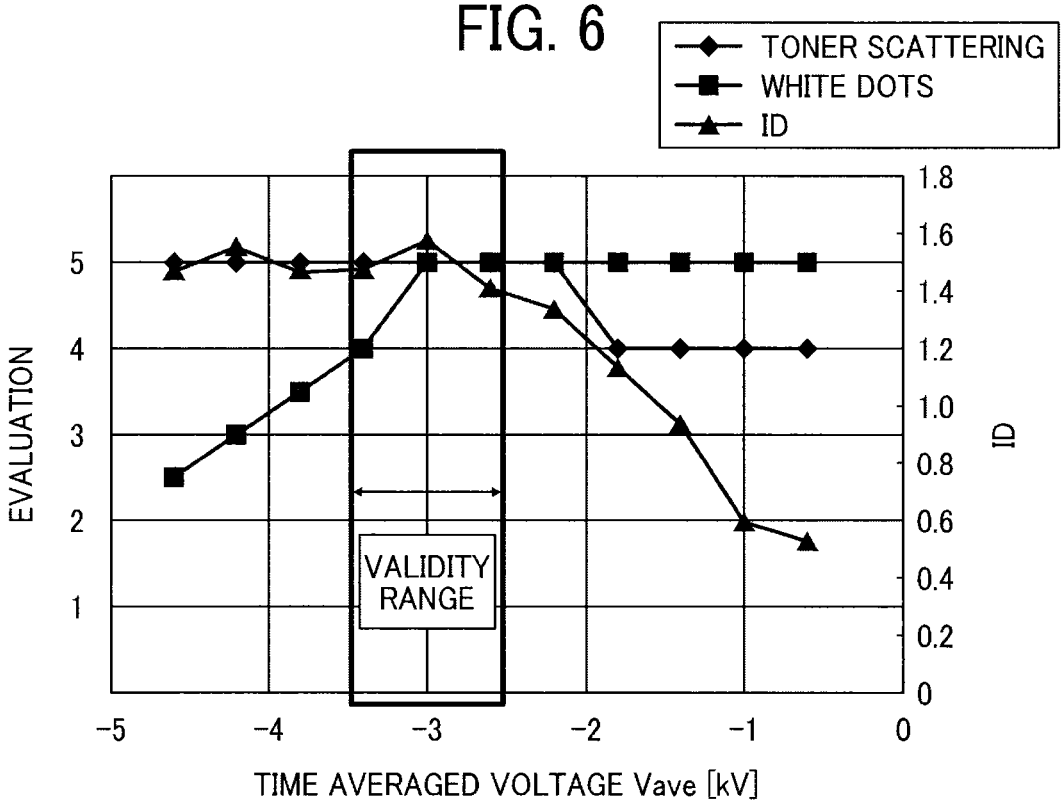
FIG. 6 is a graph illustrating a relation between a time-average voltage of the superimposed voltage and the evaluations of the white dots and the toner scattering, and image density of a single magenta solid image obtained from experiment 3 when the single magenta solid image is transferred onto the second side of the recording sheet.
Figure 7:
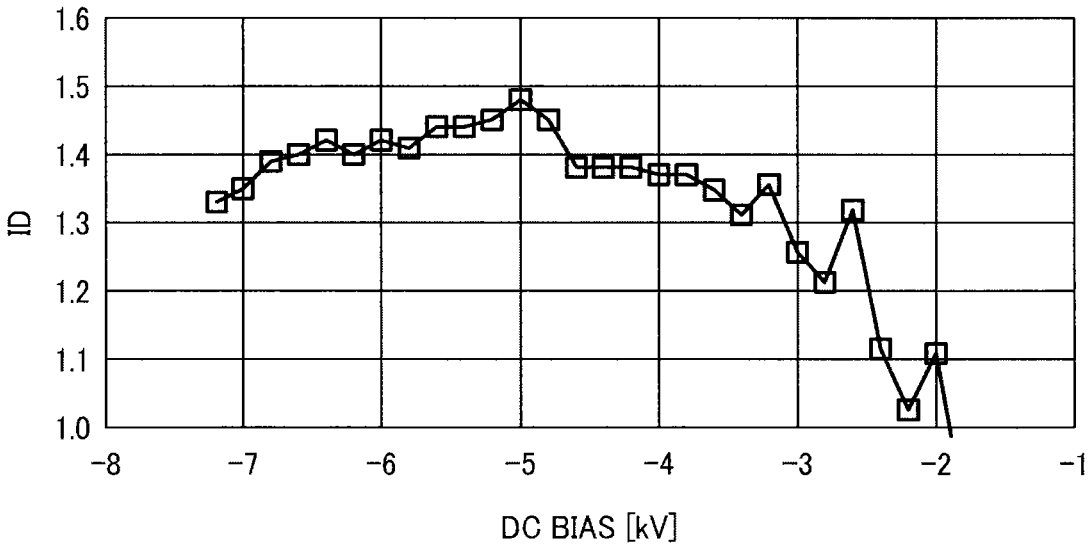
FIG. 7 is a graph illustrating a relation between the DC voltage and the image density.

FIG. 6 illustrates the evaluation result of the magenta single color solid image formed on the second side of the recording sheet P in the experiment 3. As is clear from FIG. 6, under conditions in which the time-averaged voltage Vave of the superimposed bias is set in a range from −2.6 [kV] to −3.4 [kV], the white dots and the toner scattering can be set within the acceptable range that is grade 4 and 5, and the image density ID can be set equal to or greater than 1.4.

The following reason can be given for the result. That is, when the superimposed bias is used as the secondary transfer bias, the alternating current electrical field between the secondary transfer rear roller 33 and the nip forming roller 36 is formed. Accordingly, the toner is relatively moved to the surface of the recording sheet P while reciprocally moving in the secondary transfer nip between the belt surface and the recording sheet P.

During the process, after the toner scattered around the image forming area in the recording sheet P is returned to the belt surface, the scattered toner is transferred onto the image of the recording sheet P, therefore, the toner scattering is less likely to generate in the vicinity of the image. Further, when the toner adhering to the recording sheet P is returned to the belt surface, the returned toner bumps into a toner on the belt surface, which promotes the separation of the toner from the belt surface and the toner movement from the belt surface to the sheet surface.

As a result, the occurrence of the toner scattering and the insufficient image density can be prevented by a direct current component having smaller value than the DC bias, thereby hardy generates the white dots. Accordingly, although those could not prevented by using the DC bias, insufficient image density, the generation of the toner scattering and the white dots can be prevented in this condition.

[Experiment 4]

Figure 8:
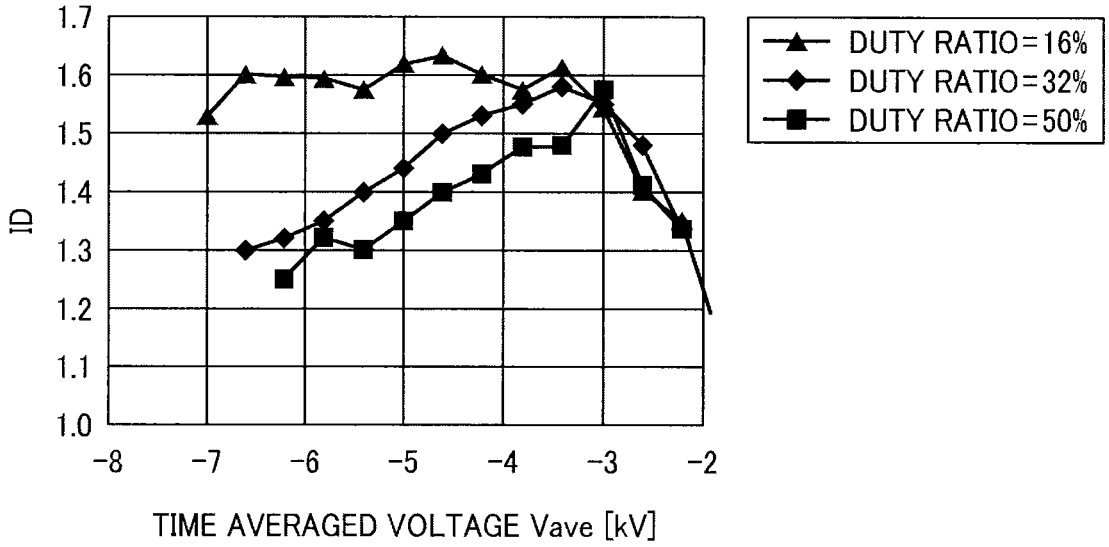
FIG. 8 is a graph illustrating a relation between the time-average voltage of the superimposed voltage and image density obtained from experiment 4 when a duty ratio is changed.
Figure 9:
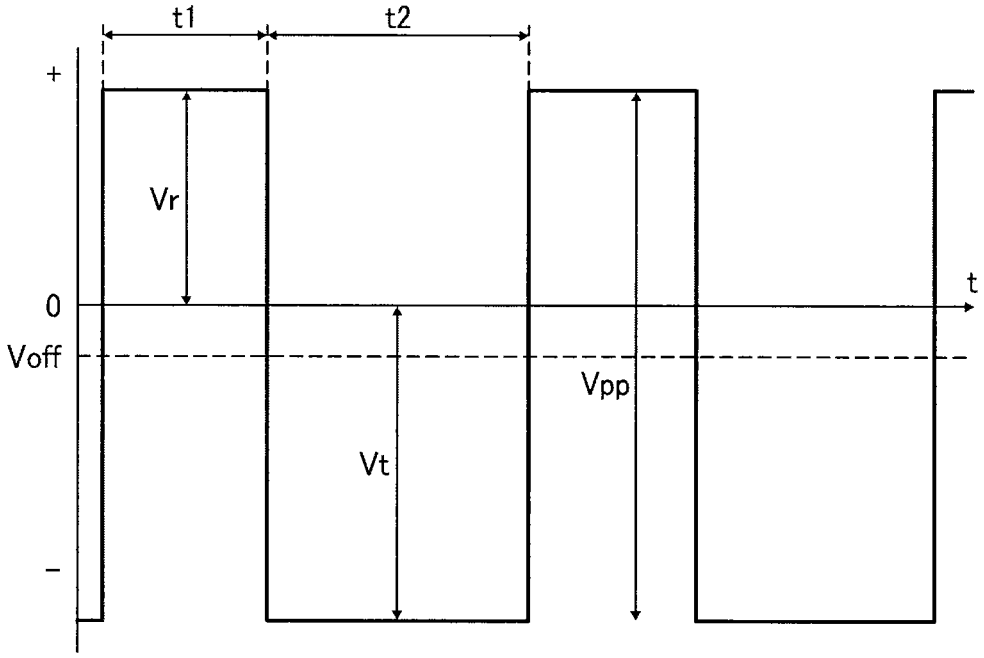
FIG. 9 is a waveform diagram illustrating a rectangular wave of an alternating current voltage contained in the superimposed bias output from the secondary transfer bias power supply used in experiment 4.

When the DC bias is used as the secondary transfer bias, similarly to the experiment 2, as illustrated in FIG. 9, by setting the greater value of the DC bias at a certain degree, as illustrated in FIG. 9, the image density ID of 1.4 or more can be obtained. In addition, when the superimposed bias is used similarly to the experiment 3, as illustrated in FIG. 8, by setting the time-averaged voltage Vave to a suitable value, the acceptable image density ID of 1.4 or more can be attained.

Herein, the suitable value for the image density ID varies in accordance with the duty ratio in the toner transfer direction. As described above, although the AC voltage having 50% duty ratio in the toner transfer direction in the experiment 3, when the duty ratio is set less than 50%, the suitable range becomes greater as follows. The experiment 4 was carried out under conditions in which the duty ratio is different from the experiment 3.

In the experiment 4, as the AC voltage in the superimposed bias, the peak-to-peak voltage Vpp is 6 [kV], the duty ratio in the toner returning direction is 40%, the frequency f is 500 [Hz]. As for the waveform of the AC voltage, a rectangular wave was used, illustrated in FIG. 9. In FIG. 9, a horizontal line indicated by a broken line positioned at the offset voltage Voff is a central line of the rectangular wave of the peak-to-peak voltage. The area surrounded by the positive polarity side and the centerline of the wave functions as the area in the toner retuning direction. Using this border, the area surrounded by the negative polarity side and the center line of the wave functions as the area in the toner sending direction (toner transfer direction). In case of the rectangular wave shown in FIG. 9, the area in the toner returning side is smaller than the area in the toner sending side, the duty ratio in the toner returning side is 40%.

In addition to the bias condition, the grades of the toner scattering and the white dots for the magenta single color solid image formed on the second side of the recording sheet P were evaluated in the similar condition (10° C. and 15%) and the image density ID was measured.

Figure 10:
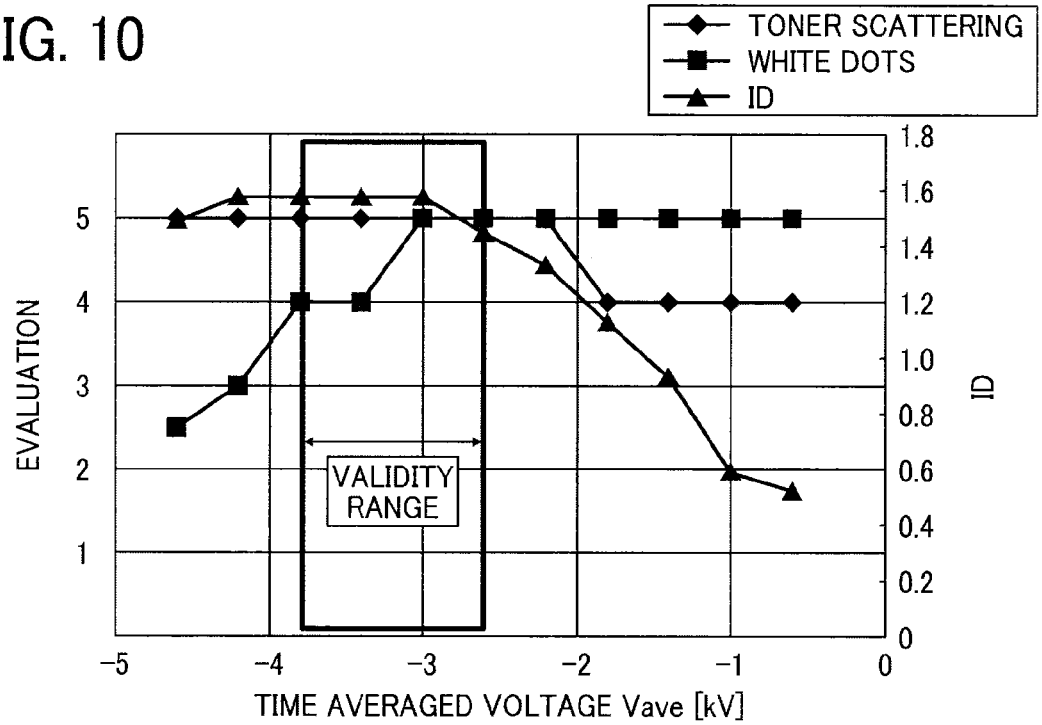
FIG. 10 is graph illustrating a relation between the time-average voltage of the superimposed voltage and the evaluations of the white dots and the toner scattering, and image density of the single magenta solid in experiment 4 when the single magenta solid image is transferred.

FIG. 10 shows the evaluation and measured result. As is clear in FIG. 10, under conditions in which the time-averaged voltage Vave of the superimposed bias is set in a range from −2.6 [kV] to −3.8 [kV], the occurrence of the white dots and the toner scattering can be kept in the acceptable range (grade 4 or 5), and the acceptable image density ID of 1.4 or more can be obtained.

[Experiment 5]

In the experiment 5, the AC voltage in the superimposed bias is the peak-to-peak voltage Vpp having 6 [kV], the ratio in the toner returning direction the frequency is 500 [Hz], the waveforms is a rectangular wave. In the superimposed bias, by adjusting the offset voltage Voff, the time-averaged voltage Vave is gradually increased in a range from −0.6 [kV] to −6.6 [kV] in −0.4 [kV] increments, and the duplex printing is performed in respective conditions. Except the bias condition, the toner scattering and the white dots for the magenta single color solid image formed on the second side of the recording sheet P were evaluated and the image density ID was measured, under the same condition of the experiment 4 (temperature: 10° C., humidity: 15%)

Figure 11:
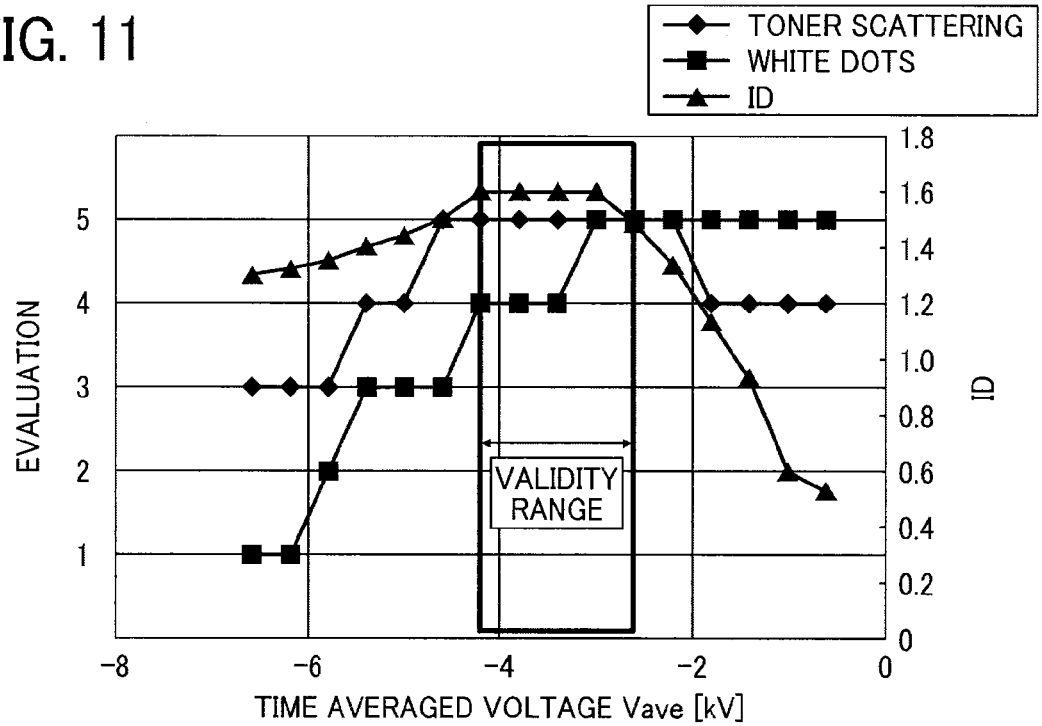
FIG. 11 is graph illustrating a relation between the time-average voltage of the superimposed voltage and the evaluations of the white dots and the toner scattering, and image density of the single magenta solid in experiment 5 when the single magenta solid image is transferred.

The result was shown in FIG. 11. As illustrated in FIG. 11, under conditions in which the time-averaged voltage Vave in the superimposed bias is set in a range from −2.6 [kV] to −4.2 [kV], the white dots and the toner scattering can be kept in the acceptable range (grade 4 or 5), and the acceptable image density ID of 1.4 or more can be obtained.

[Experiment 6]

In the experiment 6, as the AC voltage in the superimposed bias, the peak-to-peak voltage Vpp=7 [kV], the duty ratio in the toner returning direction is 16%, the frequency is 500 [Hz], and the waveforms is rectangular wave. The time-averaged voltage Vave in the superimposed bias varies based on the adjustment of the offset voltage Voff as appropriate, and the duplex printing was performed in the respective conditions. Except the bias condition, the toner scattering and the white dots for the magenta single color solid image formed on the second side of the recording sheet P were evaluated and the image density ID was measured, under the same condition to the experiment 5 (temperature: 10° C., humidity: 15%)

Figure 12:
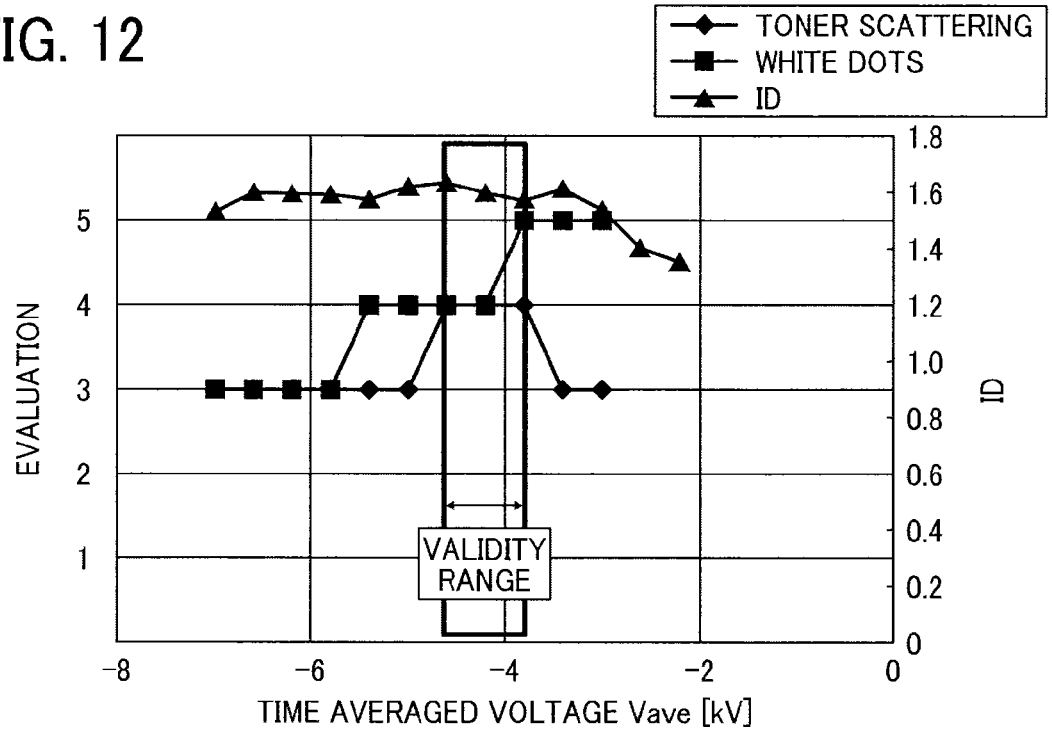
FIG. 12 is graph illustrating a relation between the time-average voltage of the superimposed voltage and the evaluations of the white dots and the toner scattering, and image density of the single magenta solid in experiment 6 when the single magenta solid image is transferred.

The result was shown in FIG. 12. As illustrated in FIG. 12, under conditions in which the time-averaged voltage Vave in the superimposed bias is set in a range from −3.8 [kV] to −4.6 [kV], the white dots and the toner scattering can be kept in the acceptable range (grade 4 or 5), and the acceptable image density ID of 1.4 or more can be obtained.

Herein, the peak-to-peak voltage Vpp is set 6 [kV] in the experiments 1 through 5. While, the peak-to-peak voltage Vpp is set 7 [kV] in the experiment 6. The reason of the set value is provided as below.

That is, under conditions in which the peak-to-peak voltage Vpp is kept constant, as the duty ratio in the toner returning direction becomes low, the time-averaged voltage Vave becomes grater in the toner transfer direction. Therefore, as the duty ratio in the toner returning side becomes low, the ability to transfer the toner from the belt side to the sheet side between the surface of the belt and the surface of the recording sheet P closely contact each other.

However, in order to achieve this effect, it is necessary condition for the toner to reciprocally move between the surface of the belt and the surface of the sheet reliably, using the AC electrical field.

If the toner cannot be returned from the surface of the sheet to the surface of the belt, the toner adhering to the surface of the belt does not bump into the returned toner, and phenomenon to promote the separation of the toner from the belt surface cannot be achieved. As a result, sufficient transfer performance cannot be achieved.

If the duty ratio in the toner returning direction becomes low, the ability to move the toner from the belt side to the sheet side is improved, while, the ability to move the toner from the belt side to the sheet side reduces. Thus, the toner is hardly returned from the sheet surface to the belt surface.

In the experiment 6, when the peak-to-peak voltage Vpp is set 6 [kV] similarly to the experiments 1 through 5, the toner cannot be returned from the sheet surface to the belt surface, so the transfer performance ends up being reduced.

Accordingly, by increasing the peak-to-peak voltage Vpp to 7 [kV] so that the peak-to-peak voltage Vpp is greater than a returning peak Vr [V], the toner can be returned from the sheet surface to the belt surface at once.

In the following experiment 7, the peak-to-peak voltage Vpp is increased to 8 [kV] by similar reason described above.

[Experiment 7]

In the experiment 7, as for the AC voltage in the superimposed bias, the peak-to-peak voltage Vpp is 8 [kV], the duty ratio in the toner returning direction is 8%, the frequency f is 500 [Hz], and the waveforms is the rectangular wave. The time-averaged voltage Vave in the superimposed bias varies based on the adjustment of the offset voltage Voff as appropriate, the duplex printing was performed in the respective conditions. Except the bias condition, the toner scattering and the white dots for the magenta single color solid image formed on the second side of the recording sheet P were evaluated and the image density ID was measured under the same condition to the experiment 6 (temperature: 10° C., humidity: 15%)

Figure 13:
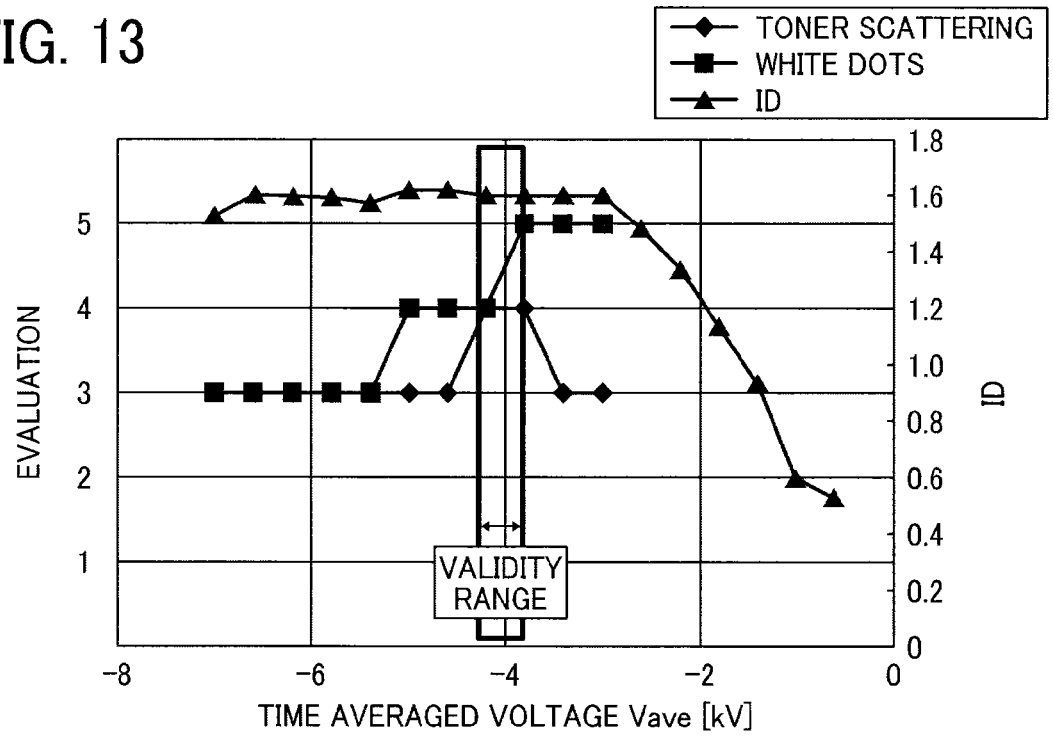
FIG. 13 is graph illustrating a relation between the time-average voltage of the superimposed voltage and the evaluations of the white dots and the toner scattering, and image density of the single magenta solid in experiment 7 when the single magenta solid image is transferred.

The result is shown in FIG. 13. As illustrated in FIG. 13, under conditions in which the time-averaged voltage Vave in the superimposed bias is set in a range from −3.8 [kV] to −4.2 [kV], the white dots and the toner scattering can be kept in the acceptable range (grade 4 or 5), and the acceptable image density ID of 1.4 or more can be obtained. Herein, if the duty ratio in the toner returning direction is set greater than 50%, when the DC voltage is not applied, the time-averaged voltage Vave becomes to a polarity that is same to that in toner retuning direction. Accordingly, the toner image cannot be transferred onto the surface of the recording sheet P.

When the DC voltage is applied, the time-averaged voltage Vave can become to equal polarity to that in the toner transfer direction. However, since the time-averaged voltage Vave is set to the polarity in the in the toner returning direction before the DC voltage is applied, the efficiency is reduced (inefficient). Therefore, setting the duty ratio in the toner returning direction is not impractical in view of the energy efficiency.

To put the experiment results 3 through 7 together, at low temperature and low humidity, when the toner image is transferred onto the second side, in the range of the duty ratio in the toner returning direction within 8% to 50%, the suitable range of the time-averaged voltage Vave is in a range from −2.6 [kV] to −4.6 [kV].

By contrast, at low temperature and low humidity, when the toner image is transferred onto the first side, the proper range of the DC bias is in a range from −4.8 [kV] to −6.0 [kV], as is clear from the experiment 2. The proper range of the DC bias is not overlapped with the proper range of the time-averaged voltage Vave and is greater than that of the time-averaged voltage Vave. Accordingly, when the toner image is transferred onto the second side, an absolute value of the in the superimposed bias is set smaller than an absolute value of the DC bias when the toner image is transferred onto the first side. With this setting, the toner scattering and the white dots can be kept in the acceptable level of grade 4 or 5, and the acceptable image density ID of 1.4 or more can be obtained.

First Embodiment

In this embodiment, when the toner image is transferred onto the first side of the recording sheet P in the duplex printing mode or single-side printing mode, the controller 200 (see FIG. 3) outputs the first-side transfer signal to the transfer bias power supply 39. When the toner image is transferred onto the second side of the recording sheet P in the duplex printing mode, the controller 200 outputs the second-side transfer signal to the transfer bias power supply 39.

While receiving the first-side transfer signal from the controller 200, the transfer bias power supply 39 outputs the DC bias to generate a first electric potential difference containing only the DC voltage as the transfer bias. Thus, compared to a configuration in which the superimposed bias in which the AC voltage is superimposed on the DC voltage is always output, the discharge between the secondary transfer rear roller 33 and the nip forming roller 36 can be reduced. Therefore, the deterioration of the secondary transfer rear roller 33 and the nip forming roller 36 and the intermediate transfer belt 31 caused by the discharge can be retarded.

By contrast, while receiving the second-side transfer signal from the controller 200, the transfer bias power supply 39 outputs the superimposed bias to generate a second electric potential difference in which the AC voltage is superimposed on the DC voltage as the transfer bias. Thus, compared to when the DC bias is output, the occurrence of the white dots and the toner scattering may alleviated.

In addition, based on the above-described experiment results, in the secondary transfer bias power supply 39 in the image forming apparatus 100, an absolute value of the time-averaged voltage Vave of the superimposed bias (second electric potential difference) when the toner is transferred onto the first side of the recording sheet is smaller than an absolute value of the time-averaged voltage Vave of the DC bias (first electric potential difference) when the toner is transferred onto the first side.

That is, in this embodiment, the processor 200 causes the electric potential difference generator 39 to generate a first electric potential difference containing only a direct current (DC) component when the toner image is transferred onto the first side of the recording sheet, and to generate a second electric potential difference containing a DC component and an alternating current (AC) component when the toner image is transferred onto the second side of the recording sheet P. The second electric potential difference has an averaged absolute value (Vave) per unit time smaller than an absolute value of the first electric potential difference.

Thus, the generation of the white dots, the toner scattering, the insufficient image density can be reliably prevented.

In the configuration in the image forming apparatus shown in FIG. 1, the secondary transfer bias is applied to a core metal of the secondary transfer rear roller 33, and a core metal of the nip forming roller 36 is electrically grounded. With this configuration, the time-averaged voltage Vave of the secondary transfer bias constituted by the superimposed bias becomes equal to an electric potential difference of DC component Eoff as a time-averaged value of the electric potential difference between the secondary transfer rear roller 33 and the nip forming roller 36. These values Vave and Eoff become equal to the offset voltage Voff that is the DC component of the superimposed bias.

Instead of the core metal of the nip forming roller 36 connected to ground, when the DC voltage is applied to the core metal of the secondary transfer rear roller 33, the superimposed value of the DC voltage applied to the core metal of the secondary transfer rear roller 33 and the DC voltage applied to the core metal of the nip forming roller 36 treats as the offset voltage Voff. That is, instead of the core metal of the nip forming roller 36 connected to ground, when the DC voltage is applied to the core metal of the nip forming roller 36, the electric potential difference of DC component Eoff becomes equal to the offset voltage Voff.

A method to generate the electric potential difference containing the DC component and AC component between a nip forming member (e.g., nip forming roller 36) and a backside contact member (e.g., secondary transfer rear roller 33); following 6 patterns can be considered as follows.

(1): The superimposed bias is applied to the nip forming member, and the backside contact member is electrically grounded.

(2): The superimposed bias is applied to the nip forming member, and the DC bias is applied to the backside contact member.

(3): The AC bias constituted only by the AC component is applied to the nip forming member, and the DC bias is applied to the backside contact member.

(4): The nip forming member is electrically grounded, and the superimposed bias is applied to the backside contact member.

(5): The DC bias is applied to the nip forming member, and the superimposed bias is applied to the backside contact member.

(6): The DC bias is applied to the nip forming member, and the AC bias constituted only by the AC component is applied to the backside contact member.

These 6 patterns, any pattern can be adopted. In any patterns, the absolute value of the time-averaged electric potential difference Eoff when the toner image is secondary transferred onto the second side of the recording sheet P is set lower than the electric potential difference (absolute value of the DC bias) when the toner image is transferred onto the first side of the recording sheet P.

Figure 14:
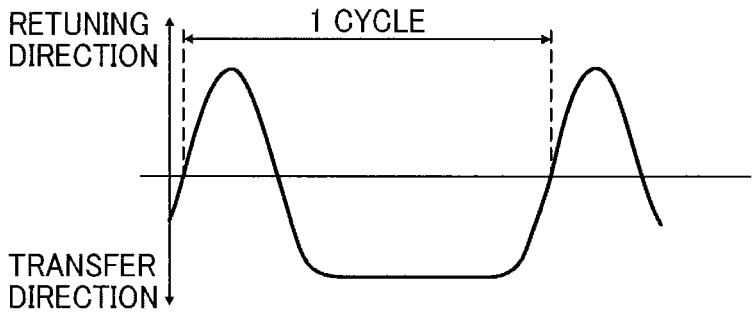
FIG. 14 is a waveform diagram illustrating a variation waveform of AC bias that is neither a rectangular wave nor a sine wave.
Figure 15:
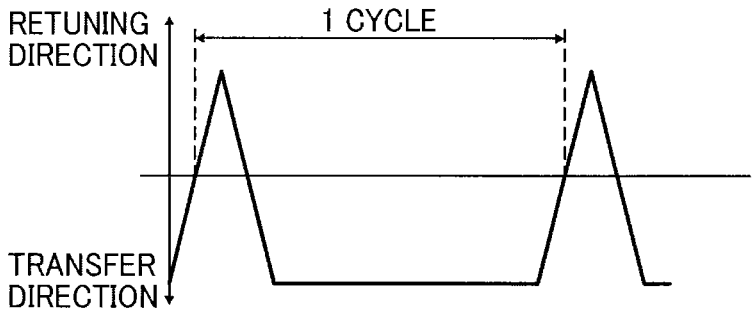
FIG. 15 is waveform diagram illustrating another variation waveform of AC bias that is neither a rectangular wave nor a sine wave.
Figure 16:
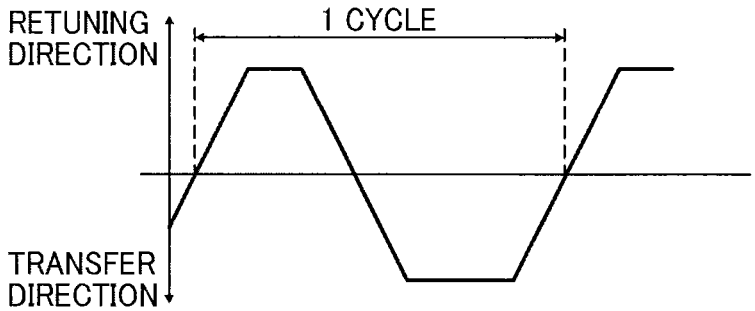
FIG. 16 is waveform diagram illustrating another variation of a waveform of AC bias that is neither a rectangular wave nor a sine wave.
Figure 17:
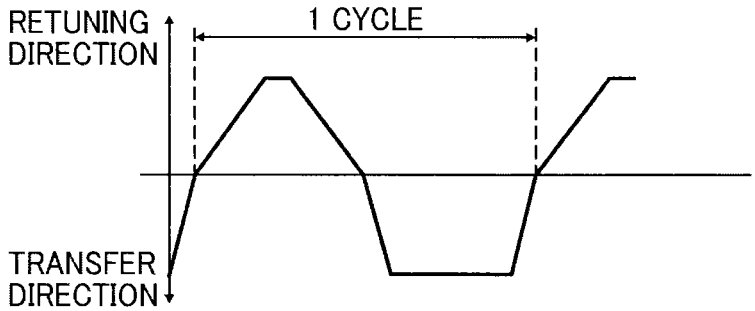
FIG. 17 is a waveform diagram illustrating yet another variation of a waveform of AC bias that is neither a rectangular wave nor a sine wave.

It is to be noted that, in above-described experiments, sine wave and rectangular waveform is used as the AC voltage in the superimposed bias, the shape of waveforms is not limited above. For example, as illustrated in FIG. 14, the AC voltage is formed by curved waveforms whose positive peak and negative peak are not symmetrical in 1 cycle. As illustrated in FIG. 15, the AC voltage is formed by a triangular wave appearing at a predetermined cycle. As illustrated in FIG. 16, the AC voltage is formed by a trapezoidal wave that repeats rising and falling at a predetermined cycles. As illustrated in FIG. 17, the AC voltage is formed by combination of a first trapezoidal wave that repeats rising and falling at a predetermined cycles and a trapezoidal wave, non symmetrically to the first trapezoidal wave, that falls at a predetermined cycles.

Adopting the superimposed bias as the secondary transfer bias when the toner image is secondary transferred onto the second side of the recording sheet P, it makes possible to obtain the image density ID of 1.4 or more. This reason is as follows.

Even if the time-averaged voltage Vave (or time-averaged electric potential difference Eoff) has a smaller value that does not generate the white dots, the toner returned from the sheet surface to the belt surface by the AC electrical field bumps into the toner adhering to the belt surface. Thus, by promoting the separation of the toner from the belt surface, a lot of toner is made possible to be adhering to the sheet surface. Accordingly, in the secondary transfer nip, the toner is needed to reciprocate between the sheet surface and the belt surface at least twice.

However, considering the experiments, in the event that the toner reciprocate twice, the effect to promote the separation of the toner from the belt surface by making the toner returned to the belt surface hits the toner adhering to the belt surface, is not surely achieved, and the cyclical unevenness in the image density may occur based on whether or not the effect can be achieved or not.

In order to avoid the cyclical unevenness in the image density, the toner is needed for four times round trip. Accordingly, in the image forming apparatus, a passing time of the recording sheet P through the secondary transfer nip is set equal to or longer than four times of the cycle in the AC component in the superimposed bias as the secondary transfer bias.

More specifically, representing the frequency as f [Hz], the nip width corresponding to a length in a direction in which the recording sheet is transported in the transfer nip as d [mm], and process linear velocity as v [mm/s], following relations obtains.

$$f>(4/d)\times v \quad (1)$$

Thus, the cyclical unevenness in the image density caused by the shortage of the number of the toner reciprocation movement of the toner between the sheet surface and the image carrier surface can be prevented In addition, in the image forming apparatus 1000, the secondary transfer bias power supply 39 may output the secondary transfer bias constituted by the superimposed bias having following characteristics when the toner image is transferred onto the second side of the recording sheet P. That is, the secondary transfer bias power supply 39 outputs a superimposed bias whose duty ratio in the in the toner returning direction is lower than 50%. This setting has following reasons.

The AC voltage having 50% duty ratio is most popular. When this popular AC voltage having 50% duty ratio is used, the time-averaged voltage Vave becomes equal to the offset voltage Voff. Then, in this case, although the AC voltage made the toner just reciprocate between the belt surface and the sheet surface, which has no action for the toner to relatively move from the belt surface to the sheet surface. The transfer (relatively moving) action is carried out by the offset voltage Voff.

By contrast, the AC voltage whose duty ratio in the toner returning direction is lower than 50% according to the present configuration can achieve the action of relatively movement from the belt surface to the sheet surface in addition to the action of the reciprocation between the belt surface an the sheet surface.

Therefore, a desired image density ID can be obtained by a smaller offset voltage Voff, which can obtain the desired image density ID at low energy.

Furthermore, the secondary transfer bias power supply 39 may output the secondary transfer bias constituted by the superimposed bias having following characteristic when the toner image is transferred onto the second side of the recording sheet P. That is, the secondary transfer bias power supply 39 outputs a superimposed bias whose duty ratio in the in the toner returning direction is equal to or higher than 8%. This setting has following reasons.

In the experiment, if the duty ratio in the toner returning direction is set lower than 8%, the secondary transfer bias power supply 39 becomes impossible to output a desired waveform. By contrast, by setting the duty ratio equal to or over 8%, the secondary transfer bias power supply 39 can reliably output a desired waveform.

Second Embodiment

Next, a second embodiment of the control of the power supply 39 is described bellow. Herein, other than the difference described below the image forming apparatus according to the second embodiment has a configuration similar to the configuration of the image forming apparatus 1000 in the first embodiment.

As illustrated in FIG. 3, the controller 200 is connected to the control panel via the I/O interface 201. The control panel 300 includes a liquid crystal display and a key operation portion consisting of the multiple touch keyboards. The control panel 300 displays various type of literal information and receives input data from the user key control in the key operation portion. The user can set and switch the printing mode between the energy saving mode and the high image quality mode by operating key control to the key operation portion in the control display 300 or operating printer utility software installed in a personal computer.

In the energy saving mode, the DC bias is used as the secondary transfer bias when the toner image is transferred onto the second side of the recording sheet P, similarly to when the toner image is transferred onto the first side of the recording sheet P. With this operation, since the AC voltage is not always used, the power consumption can be reduced, compared to the case of using the superimposed bias.

By contrast, in the high image quality mode, the superimposed bias is used as the secondary transfer bias, differing from the secondary transfer bias when the toner image is transferred onto the first side of the recording sheet P.

Theses mode switching is carried out by key operation in the control display 300 and operating the printer utility software of the personal computer. When the user operates the printer utility software, the controller 200 receives the operation information transmitted from the personal computer and controls the switching of the transfer mode. When the transfer mode is switched, the controller 200 transmits the data after switching to the secondary transfer bias power supply 39.

With this embodiment, when the toner image is transferred onto the second side of the recording sheet P, the controller 200 selects whether the secondary transfer bias power supply 39 generates a DC bias containing the DC component alone or a superimposed bias (superimposed component) in which an AC component is superimposed on a DC component as the transfer bias. In this configuration, when the toner image is transferred onto the second side of the recording sheet P, the processor 200 selectively switches the electric potential difference generator 39 between a second DC electric potential difference containing the DC component alone and a second superimposed electric potential difference containing the superimposed component in which the AC component is superimposed on an AC component, based on the command from the user. Herein, the second superimposed electric potential difference has an averaged absolute value per unit of time smaller than an absolute value of the first electric potential difference.

Thus, if the user wants to save energy prefer to the high image quality of the image transferred onto the second side, printing is carried out in the image forming apparatus in the energy save mode.

(Variations of Second embodiment)

In FIG. 3, the humidity sensor 301, serving as an ambient condition detector, is connected to the controller 200 via the I/O interface 201. The humidity sensor 301 detects humidity in the image forming apparatus 1000 and sends the detection result as the digital data to the controller 200. As described above, under the normal experimental laboratory conditions of normal temperature and normal humidity (temperature: 23° C., humidity: 50%), the white dots and the toner scattering can be kept in the acceptable level of grade 4 or 5, and the acceptable image density ID of 1.4 or more can be obtained. However, when the superimposed bias is used as the secondary transfer bias, the deterioration in the member positioned vicinity of the secondary transfer nip is wastefully hastened, and energy is wastefully consumed.

Therefore, in this variation, when the toner image is transferred onto the second side of the recording sheet P, the controller (processor) 200 can selectively switch the electric potential difference generator 39 between the second DC electric potential difference containing the DC component (DC bias) alone and the second superimposed electric potential difference containing the superimposed component (superimposed bias) in which the AC component is superimposed on the AC component, based on the detection result of the humidity sensor (ambient condition detector) 301.

More specifically, when the detection result of the humidity sensor 301 exceeds a predetermined lower limit humidity, even when the DC bias is used as the secondary transfer bias, the white dots and the toner scattering can be kept in the acceptable level of grade 4 or 5, and the acceptable image density ID of 1.4 or more can be obtained. Then, in this case, the secondary transfer bias power supply 39 output the DC bias as the secondary transfer bias.

By contrast, when the detection result of the humidity sensor 301 is lower than the predetermined lower limit, the secondary transfer bias power supply 39 outputs the superimposed bias as the secondary transfer bias.

With this configuration, when the humidity in the image forming apparatus is so high that white dots and the toner scattering can be kept in the acceptable level of grade 4 or 5 and the acceptable image density ID of 1.4 or more can be attained, the DC bias is used as the secondary transfer bias when the toner image is transferred onto the second side of the recording sheet P, which reduces energy consumption and retards the deterioration of the member surrounding the secondary transfer nip.

Herein, temperature correlates with the humidity in the image forming apparatus. Accordingly, instead of the detection result of the humidity sensor 301, when the toner image is transferred onto the second side of the recording sheet P, the controller (processor) 200 can selectively switch the electric potential difference generator 39 between the second DC electric potential difference containing the DC component alone or the second superimposed electric potential difference containing the superimposed bias in which the AC component is superimposed on the DC component, as the second transfer bias, based on the detection result of a temperature detector.

Alternatively, in FIG. 3, the sheet-resistance detector (measuring device) 302 is connected to the processor 200 via the I/O interface 201. The sheet-resistance detector 302 detects electronic resistance of the recording sheet P before passes through the secondary transfer nip, and output the result as digital data. This sheet-resistance detector 302 may be positioned upstream from the registration rollers 102. The sheet-resistance detector 302 includes a pair of metal rollers, positioned upstream from the registration rollers 102, and a current detector to detect a current flowing between the metal rollers while applying a constant voltage between the metal rollers. Thus, the sheet-resistance detector 302 detects the electrical resistance based on the current following between the metal rollers when the metal rollers clamp the recording sheet P before clamped between the registration pair.

In a state in which the electrical resistance of the recording sheet P is relatively low, for example, under high-humidity condition, the DC bias is used as the secondary transfer bias when the toner image is transferred onto the second side of the recording sheet P. In this case, the white dots and the toner scattering can be kept within the acceptable level of grade 4 or 5 and the acceptable image density ID of 1.4 or more can be obtained. In this state in which the low electrical resistance of the recording sheet P is used, if the superimposed bias is used as the secondary transfer bias, the deterioration of the member around the secondary transfer nip may be wastefully hastened, and energy may be wastefully consumed.

Therefore, in this variation, when the toner image is transferred onto the second side of the recording sheet, the controller (processor) 200 can selectively switch the electric potential difference generator 39 between the second DC electric potential difference containing the DC component (DC bias) alone and the second superimposed electric potential difference containing the superimposed component (superimposed bias) in which the AC component is superimposed on the AC component, based on the detection result of the sheet-resistance detector 302.

More specifically, when the detection result of the sheet-resistance detector 302 falls below a predetermined upper limits humidity, even when the DC bias is used as the secondary transfer bias, the white dots and the toner scattering can be kept in the acceptable level of grade 4 or 5, and the acceptable image density ID of 1.4 or more can be obtained. In this case, the secondary transfer bias power supply 39 outputs the DC bias as the secondary transfer bias.

While, when the detection result of the sheet-resistance detector 302 is lower than the predetermined upper limit, the secondary transfer bias power supply 39 outputs the superimposed bias as the secondary transfer bias.

With this configuration, when the electric resistance of the recording sheet P is so low that the white dots and the toner scattering can be kept in the acceptable level of grade 4 or 5 and the acceptable image density ID of 1.4 or more can be obtained, the DC bias is used as the secondary transfer bias when the toner image is transferred onto the second side, which reduces energy consumption and retards the deterioration of the member surrounding the secondary transfer nip.

(Variation of Transfer Units)

Next, variations of the secondary transfer units are described below. In followings, the configuration of the image forming apparatus is similar described above.

Figure 18:
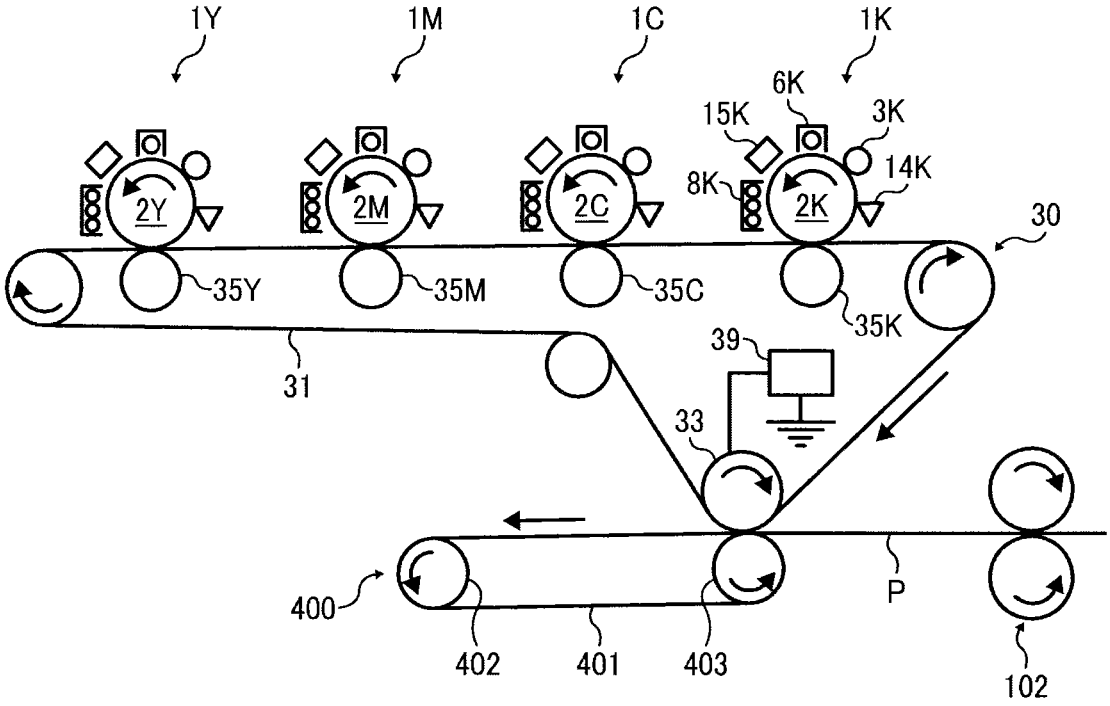
FIG. 18 is a schematic diagram illustrating a variation of four image forming units, transfer unit, and a transfer-transport unit using an intermediate transfer system.

FIG. 18 is schematic diagram illustrating a transport portion according to a variation of a nip forming member. In an image forming unit 1K, a discharging lamp 14K, a drum cleaning device 3K, a charging device 6K, an optical writing unit 15K, and a development device 8K are provided on the photoconductor drum 2K. The optical writing unit 15K includes LED array to emit light to optically write the electrostatic latent image on the photoconductor drum 2K. The intermediate transfer belt 31 in the transfer nip 30 passes under the respective photoconductive drums 2Y, 2M, 2C, and 2K, in conjunction with the endless rotation of the intermediate transfer belt 31, thereby forming a four color composite color image on an outer surface of the intermediate transfer belt 31.

As described above, although a configuration in which the secondary transfer nip is formed by contacting the intermediate transfer belt 31 to the nip forming roller 36, alternatively, the secondary transfer nip may be formed by contacting the intermediate transfer belt 31 and an endless nip forming belt 401.

In this configuration, between a core metal of the secondary transfer rear roller 33 positioned inside loop of the intermediate transfer belt 31 and a core metal of a pressing roller (to press nip forming belt to the intermediate transfer belt 31 from inside loop to the intermediate transfer belt), the condition in which the second electric potential difference has an averaged absolute value per unit time smaller than an absolute value of the first electric potential difference is achieved.

Beneath the intermediate transfer belt 31, a sheet transfer belt unit 400 in which a sheet transfer belt 401 is rotated is provided. In the sheet transfer belt unit 400, an endless sheet-transport belt 401 is wound around a driving roller 402 and a secondary transfer pressing roller 403, and the driving roller 402 drives the sheet-transport belt 401 to rotate counterclockwise seamlessly. The secondary transfer pressing roller 403 inside loop of the sheet-transport belt 401 contacts the secondary transfer rear roller 33 inside loop of the intermediate transfer belt 31 to form transfer nip between an outer surface of the sheet-transport belt 401 and the outer surface of the intermediate transfer belt 31.

The secondary-transfer rear roller 33 is supplied with a secondary transfer bias from a secondary transfer bias power supply 39. The secondary transfer pressing roller 403 is electrically grounded. Thus, a secondary transfer electric field is formed between the secondary-transfer rear roller 33 and the secondary transfer pressing roller 403. In this variation, the sheet-transport belt 401 and the secondary transfer pressing roller 403 functions as the nip forming member.

When the recording sheet P from the registration roller 102 reaches the secondary transfer nip, the composite toner image formed on the intermediate transfer belt 31 is transferred onto the first side of the recording sheet P in the secondary transfer nip. After passed through the secondary transfer nip, the recording sheet P is moved in conjunction with the seamless rotation of the sheet-transport belt 401 while the recording sheet P is attracted on the outer surface of the sheet-transport belt 401. The sheet-transport belt 401 wraps around the driving roller 402 at acute angle, and the sheet-transport belt 401 changes moving directions suddenly. The recording sheet P electrostatically attracted on the outer surface of the sheet-transport belt 401 cannot follow the acute angled rotation, and separates from the sheet-transport belt 401 by self striping.

After the recording sheet P is separated from the sheet-transport belt 401, the toner image on the first side of the recording sheet P is fixed in the fixing device 90 (see FIG. 1). Then, the inverting device transport the recording sheet P to the transfer nip again via the registration roller 102 if necessary, and the composite multicolor toner image is transferred and the fixed on the second side of the recording sheet P.

Similarly to the first embodiment, when the toner image is transferred onto the first side of the recording sheet P in the duplex printing mode or single-side printing mode, the controller 200 (see FIG. 3) outputs the first-side transfer signal to the transfer bias power supply 39. When the toner image is transferred onto the second side of the recording sheet P in the duplex printing mode, the controller 200 outputs the second-side transfer signal to the transfer bias power supply 39.

While receiving the first-side transfer signal from the controller 200, transfer bias power supply 39 outputs the DC bias constituted by the DC voltage as the transfer bias. While receiving the second-side transfer signal from the controller 200, the transfer bias power supply 39 outputs the superimposed bias in which the AC voltage is superimposed on the DC voltage as the transfer bias. The second electric potential difference (the superimposed bias) has an averaged absolute value per unit time smaller than an absolute value of the first electric potential difference.

Alternatively, similarly to the second embodiment, when the toner image is transferred onto the first side of the recording sheet P in the duplex printing mode or single-side printing mode, the controller 200 (see FIG. 3) outputs the first-side transfer signal to the transfer bias power supply 39. When the toner image is transferred onto the second side of the recording sheet P in the duplex printing mode, the controller 200 selects whether the secondary transfer power supply 39 generates a second DC electric potential difference containing only the DC component or a second superimposed electric potential difference containing the DC component and an AC component. The second superimposed electric potential difference containing the DC component and an AC component the superimposed bias has an averaged absolute value per unit time smaller than an absolute value of the first electric potential difference.

As an alternative configuration, the secondary-transfer rear roller 33 may be electrically grounded, and the secondary transfer pressing roller 403 is supplied with the secondary transfer bias from the secondary transfer bias power supply 39. In this case, the superimposed bias from the secondary transfer bias power supply 39 has a waveform that is line symmetric around a 0V axis shown in FIG. 4.

(Direct Transfer System)

Figure 19:
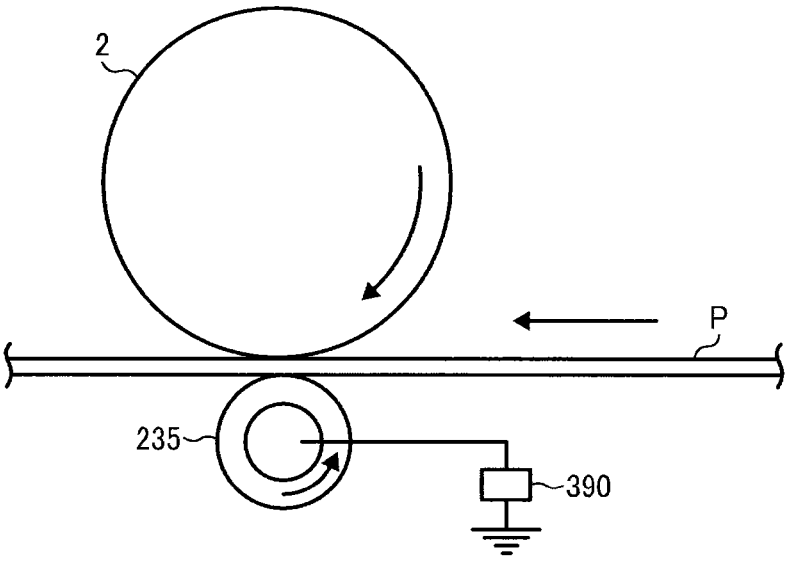
FIG. 19 is a schematic diagram illustrating a variation of a photoconductor and a transfer roller using a direct-transfer system.

FIG. 19 is a schematic diagram illustrating image forming carrier and a transfer member adopted in a direct-transfer type image forming apparatus. The image forming apparatus shown in FIG. 19 is a single color image forming apparatus. In FIG. 19, the photoconductor 2, serving as an image forming carrier, is rotated clockwise by a driving unit. Although not illustrated, a drum cleaning device, a discharging device, a charging device, a development device are provided around the photoconductor 2. Beneath the photoconductor 2, a transfer roller 235, serving as a transfer member, is provided, and a transfer nip is formed by the transfer roller 235 is pressed against the photoconductor 2 by a pressing member. The recording sheet P is passed through the transfer nip. Then, the toner image on the photoconductor is transferred onto the recording sheet P.

The transfer roller 235 is made of a rotary shaft (metal rod) and a surface of the metal rod is coated with a conductive form layer or an elastic layer. The recording sheet P after the toner image is formed on the first side upon passing the transfer nip, the toner image is fixed on the first side in the fixing device. Then, in duplex printing, the recording sheet P is transported again by an inverting device, and the toner image is transferred and the fixed on the second side.

In FIG. 19, a transfer bias power supply 390 applies a transfer bias to the transfer roller 235.

Figure 20:
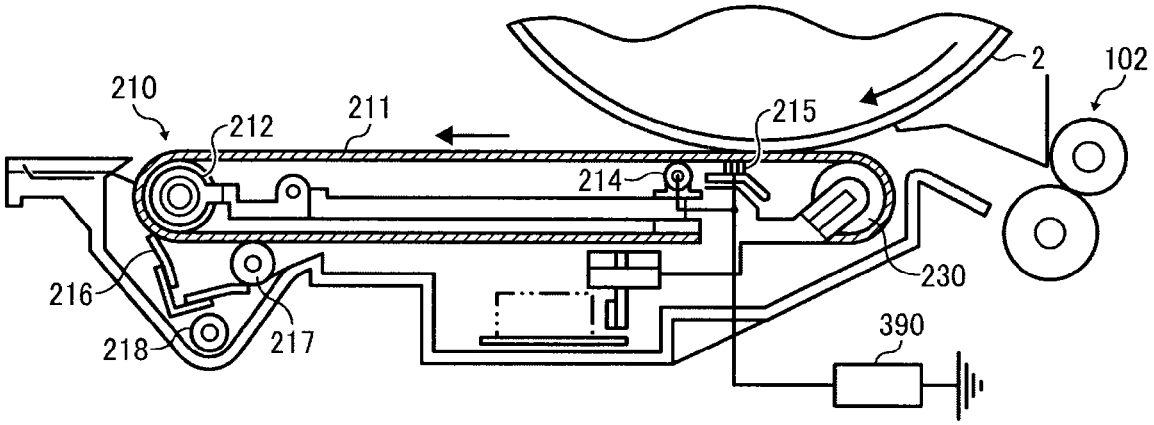
FIG. 20 is a schematic diagram illustrating another variation of a photoconductor and a transfer-transport unit using the direct-transfer system.

FIG. 20 is a schematic diagram illustrating the transfer portion in the direct transfer type. The image forming apparatus shown in FIG. 20 is a monochrome color image forming apparatus including single image forming unit 1 to form image the single color toner image. In FIG. 20, a single photoconductor drum 2 is rotated clockwise by a driving member.

Although figure is omitted, a drum cleaner, a discharging device, a charging device, a development device are provided on the photoconductor drum 2. Beneath the photoconductor drum 2, a sheet transfer belt unit 210 is provided. In the sheet transfer belt unit 210, an endless sheet-transport belt 211 is wound around a driving roller 212 and a driven roller 213, and the driving roller 212 drives the sheet-transport belt 211 to rotate counterclockwise. The sheet-transport belt 211 presses the photoconductor drum 2 to form a transfer nip. A transfer bias roller 214 and a transfer brush 215 positioned inside loop of the sheet-transport belt 201 contacting an inner side of the sheet-transport belt 211.

The registration roller 102 (see FIG. 1) transports the recording sheet P to a transfer nip between the photoconductor drum 2 and the sheet-transport belt 211. Then, the toner on the photoconductor drum 2 is transferred onto the recording sheet P in the transfer nip. The sheet-transport belt 201, a transfer bias roller 214, and a transfer brush 215 serve as the transfer members.

The transfer roller 214 may be made of a metal rod and a surface of the metal rod is coated with a conductive foam layer containing conductive foam material or a conductive elastic layer. The transfer brush 215 is made of a conductive supporter and multiple conductive straighten fibers erecting on the supporter as a brush portion.

The toner image on the first side of the recording sheet P after the toner image is transferred onto the first side upon passing through the transfer nip is fixed in the fixing device (see FIG. 1). Then, the inverting device transport the recording sheet P to the transfer nip again if necessary, and the second side of the recording sheet P is transferred and the fixed.

In FIG. 20, the transfer brush 215 is positioned downstream portion from a center position of the transfer nip and the positioned in the transfer nip so that the transfer brush 215 contacts the photoconductor drum 2 via the sheet transfer belt 211. Alternatively, the transfer brush 215 is positioned at the center position of the transfer nip, or positioned upstream from the center position. Position relation between the transfer roller 214 and the transfer brush 215 may be changed, or either the transfer roller 214 or the transfer brush 215 may be provided inside the sheet transfer belt 211.

In FIG. 20, the transfer bias power supply 390 applies the transfer bias to the transfer brush 215 and the transfer roller 214.

Figure 21:
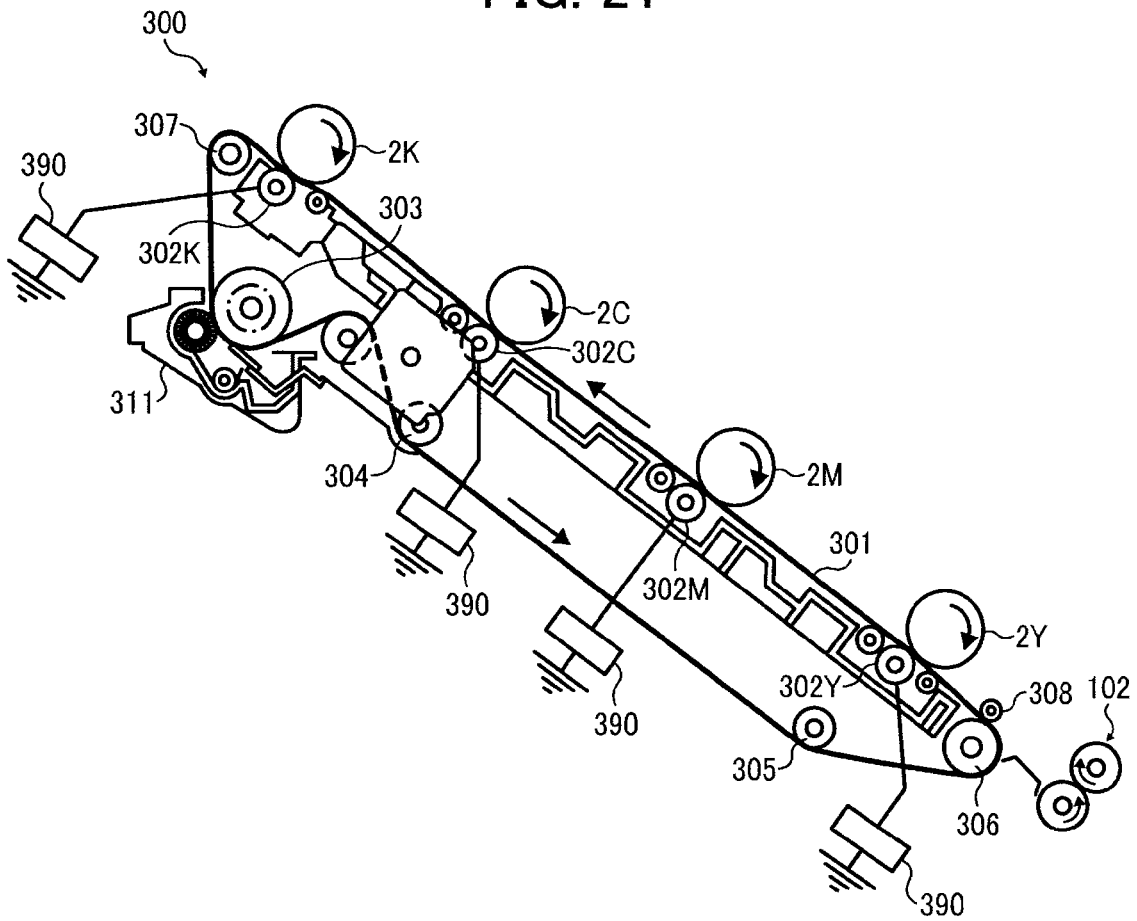
FIG. 21 is a schematic diagram illustrating another variation of four image forming units and a transfer unit using the direct-transfer system.

FIG. 21 is a schematic diagram illustrating a transfer unit 300 adopted in the direct transfer image forming apparatus. Although only the photoconductor drums 2 are illustrated in the image forming units in FIG. 21, drum cleaners, discharging devices, charging devices, a development devices are provided on the photoconductor drums 2, similarly to the image unit 1K shown in FIG. 2

Beneath the photoconductor drums 2Y, 2M, 2C, and 2K, a transfer unit 300 is provided. In the transfer unit 300, an endless transfer-transport belt 301 is wound around four transfer rollers 302Y, 302M, 302C, and 302K, a separation roller 307, a driving roller 303, a first driven roller 304, a second driven roller 305, and an entrance roller 306. The driving roller 303 drives the transfer-transport belt 301 to rotate counterclockwise seamlessly.

The transfer-transport belt 301 is sandwiched between the transfer rollers 302Y, 302M, 302C, and 302K and the photoconductor drums 2Y, 2M, 2C, and 2K. With this configuration, the photoconductor drums 2Y, 2M, 2C, and 2K contact an outer surface of the transfer-transport belt 301 to form four transfer nips, respectively. The four transfer rollers 302Y, 302M, 302C, and 302K serve as the transfer members.

Outside the loop of the transfer-transport belt 301, a sheet suction roller 308 is positioned facing to the entrance roller 306 via the transfer-transport belt 301 to form a sheet suction nip. A belt-cleaning device 311 is positioned facing the driving roller 303 via the transfer-transport belt 301 to form a belt-cleaning nip.

The transfer roller 302 may be made of a metal rod and a surface of the metal rod is coated with a conductive foam layer containing conductive foam material or a conductive elastic layer. In the configuration shown in FIG. 21, the four high-voltage power supplies 310Y, 310C, 310M, and 310K connected to the four transfer rollers 302Y, 302M, 302C, and 302K apply the transfer bias to the four transfer rollers 302Y, 302M, 302C, and 302K corresponding to the photoconductors 2Y, 2C, 2M and 2K, thereby generating a transfer electric field between the electrostatic images on the photoconductive drums 2 and the transfer rollers 302.

In addition, a sheet suction bias power supply applies a sheet suction bias to the sheet suction roller 308. The pair of registration rollers 102, disposed adjacent to the sheet suction roller 308, transports the recording sheet P to the sheet suction roller 308 as appropriate. The recording sheet P clamped in the sheet suction nip is electrostatically attracted on the outer surface of the transfer-transport belt 601. Then, in conjunction with the endless rotation of the transfer-transport belt 301, respective color images are sequentially directly passed and transferred from respective photoconductive drums 2Y, 2M, 2C, and 2K onto the first side of the recording sheet P, thereby forming a four color composite color image on the first side of the recording sheet P.

The recording medium P on which the composite color toner image is formed is passed through the K transfer nip in the last of the transfer process and then is transported a portion facing to a separation roller 307 in conjunction with the endless rotation of the transfer-transport belt 301. The transfer-transport belt 301 wraps around the separation roller 307 at acute angle, and the transfer-transport belt 301 changes moving directions suddenly. The recording sheet P electrostatically attracted on the outer surface of the transfer-transport belt 301 cannot follow the acute angled rotation, and separates from the transfer-transport belt 301 by self striping.

After the recording sheet P is separated from the transfer-transport belt 301, the toner image on the first side of the recording sheet P is fixed in the fixing device 90 (see FIG. 1). Then, the sheet-reverse device 105 transports the recording sheet P to the transfer nip again if necessary, and the monochrome toner image is transferred and the fixed on the second side of the recording sheet P.

In the variations of the direct transfer image forming apparatuses shown in FIGS. 19 through 21, the transfer bias power supply 390 applies a transfer bias to the transfer rollers 235, 214(215), and 302. Similarly above, the transfer bias power supply 390, serving as the electric potential difference generator, includes a DC voltage source and an AC voltage source and output either the DC bias or the superimposed bias in which the AC voltage is superimposed on the DC voltage.

Similarly to the first embodiment, when the toner image is transferred onto the first side of the recording sheet P in the duplex printing mode or single-side printing mode, the controller 200 (see FIG. 3) outputs the first-side transfer signal to the transfer bias power supply 390. When the toner image is transferred onto the second side of the recording sheet P in the duplex printing mode, the controller 200 outputs the second-side transfer signal to the transfer bias power supply 390.

While receiving the first-side transfer signal from the controller 200, the transfer bias power supply 390 outputs the DC bias containing only the DC voltage as the transfer bias. Thus, compared to a configuration in which the superimposed bias in which the AC voltage is superimposed on the DC voltage is always output, the discharge between the photoconductor 2 and the transfer roller 235 can be alleviated. Therefore, the deterioration of the photoconductor 2 and the transfer roller 235 caused by the discharge can be retarded.

In addition, while receiving the second-side transfer signal from the controller 200, the transfer bias power supply 390 outputs the superimposed bias in which the AC voltage is superimposed on the DC voltage as the transfer bias. Thus, compared to when the DC bias is output, by outputting the DC bias, the occurrence of the white dots and the toner scattering may alleviated.

Alternatively, similarly to the second embodiment, when the toner image is transferred onto the first side of the recording sheet P in the duplex printing mode or single-side printing mode, the controller 200 (see FIG. 3) outputs the first-side transfer signal to the transfer bias power supply 39 to output the DC bias containing only the DC voltage as the transfer bias. When the toner image is transferred onto the second side of the recording sheet P in the duplex printing mode, the controller 200 can select whether the secondary transfer power supply 39 generates the second DC electric potential difference containing only the DC component or the second superimposed electric potential difference containing the DC component and the AC component.

In the above-described intermediate transfer type image forming apparatus shown in FIGS. 1 and 18, a negative polarity toner is electrostatically repulsed against the secondary transfer rear roller 33 to which the secondary transfer bias is applied, and the toner image is electrostatically moved from the secondary transfer rear roller 33 to the intermediate transfer belt 31 side. By contrast, in this direct-transfer type image forming apparatus shown in FIGS. 19 through 21, the negative polarity toner on the photoconductor 2 is attracted onto the transfer roller to which the transfer bias (positive polarity) is applied, and the toner image is electrostatically moved from the photoconductor 2 to the transfer rollers 235, 214, and 302 sides. Therefore, a line symmetric wavelength on axis of 0V of the graph shown in FIG. 4 is used for the wavelength of the superimposed bias in this configuration. This superimposed bias has an offset voltage Voff having a positive polarity. The second electric potential difference has an averaged absolute value per unit time smaller than an absolute value of the first electric potential difference.

It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image forming device to form a toner image;

a transfer device comprising:

an intermediate transfer member having a surface to bear the toner image formed in the image forming device;

a nip forming member to press against the intermediate transfer member to form a transfer nip between the intermediate transfer member and the nip forming member; and an electric potential difference generator to generate an electric potential difference between the intermediate transfer member and the nip forming member, the transfer device transferring the toner image on the surface of the intermediate transfer member onto a recording sheet clamped in the transfer nip in a state in which the electric potential difference generator generates the electric potential difference between the intermediate transfer member and the nip forming member;

a fixing device to fix the toner image on the recording sheet after the recording sheet is passed through the transfer nip;

an inverting device to invert the recording sheet after the toner image is transferred and fixed onto a first side of the recording sheet upon passing through the transfer nip and the fixing device and to then transport the recording sheet to the transfer nip again; and a processor to cause the electric potential difference generator to generate a first electric potential difference containing only a direct current (DC) component when the toner image is transferred onto the first side of the recording sheet, and to generate a second electric potential difference containing a DC component and a superimposed alternating current (AC) component when the toner image is transferred onto a second side of the recording sheet, wherein the second electric potential difference has an averaged absolute value per unit of time smaller than an absolute value of the first electric potential difference.

2. The image forming apparatus according to claim 1, wherein, with a frequency of the AC component in the second electric potential difference represented by f [Hz], a nip width corresponding to a length in a direction in which the recording sheet is moved in the transfer nip represented by d [mm], and a surface movement velocity of the intermediate transfer member represented by V [mm/s], the following relation obtains: $f>(4/d)\times V$.

3. The image forming apparatus according to claim 1, wherein the electric potential difference generator generates the second electric potential difference having the AC component whose duty ratio in a toner returning direction in which the toner is moved from the recording sheet to the intermediate transfer member is lower than 50%.

4. The image forming apparatus according to claim 3, wherein the electric potential difference generator generates the second electric potential difference having the AC component whose duty ratio in the toner returning direction is equal to or higher than 8%.

5. The image forming apparatus according to claim 1, wherein the transfer device further comprises a facing member to contact an inner face of the intermediate transfer member to face the nip forming member via the intermediate transfer member, wherein the electric potential difference generator outputs a transfer bias to at least one of the facing member and the nip forming member to generate the electric potential difference between the intermediate transfer member and the nip forming member.

6. The image forming apparatus according to claim 5, wherein the electric potential difference generator outputs the transfer bias to the facing member.

7. An image forming apparatus, comprising:

an image forming device to form a toner image;

a transfer device comprising:

an intermediate transfer member having a surface to bear the toner image formed in the image forming device;

a nip forming member to press against the intermediate transfer member to form a transfer nip between the intermediate transfer member and the nip forming member; and an electric potential difference generator to generate an electric potential difference between the intermediate transfer member and the nip forming member, the transfer device transferring the toner image on the surface of the intermediate transfer member to the recording sheet clamped in the transfer nip in a state in which the electric potential difference generator generates the electric potential difference between the intermediate transfer member and the nip forming member;

a fixing device to fix the toner image on the recording sheet after the recording sheet is passed through the transfer nip;

an inverting device to invert the recording sheet after the toner image is transferred and fixed onto a first side of the recording sheet upon passing through the transfer nip and the fixing device and to then transport the recording sheet to the transfer nip again; and a processor to cause the electric potential difference generator to generate a first electric potential difference containing only a direct current (DC) component when the toner image is transferred onto the first side of the recording sheet, and a second electric potential difference containing either a DC component alone or a superimposed component in which an AC component is superimposed on a DC component when the toner image is transferred onto a second side of the recording sheet, the processor selectively switching the electric potential difference generator between a second DC electric potential difference containing the DC component alone and a second superimposed electric potential difference containing the superimposed component in which the AC component is superimposed on the DC component, as the second electric potential difference, wherein the second superimposed electric potential difference has an averaged absolute value per unit of time smaller than an absolute value of the first electric potential difference.

8. The image forming apparatus according to claim 7, wherein the processor selectively switches the electric potential difference generator between the second DC electric potential difference containing the DC component alone and the second superimposed electric potential difference containing the superimposed component in which the AC component is superimposed on the DC component when the toner image is transferred on the second side of the recording sheet, based on command from user.

9. The image forming apparatus according to claim 7, further comprising:

an ambient condition detector to detect ambient conditions in the image forming apparatus, wherein the processor selectively switches the electric potential difference generator between the second DC electric potential difference containing the DC component alone and the second superimposed electric potential difference containing the superimposed component in which the AC component is superimposed on the DC component, based on the detection result of the ambient condition detector.

10. The image forming apparatus according to claim 9, wherein the ambient condition detector detects at least one of temperature and humidity inside the image forming apparatus.

11. The image forming apparatus according to claim 7, further comprising:

a resistance detector to detect electrical resistance of the recording sheet, wherein the processor selectively switches the electric potential difference generator between the second DC electric potential difference containing the DC component alone and the second superimposed electric potential difference containing the superimposed component in which the AC component is superimposed on the DC component when the toner image is transferred on the second side of the recording sheet, based on the detection result of the resistance detector.

12. The image forming apparatus according to claim 7, wherein, with a frequency of the AC component in the second superimposed electric potential difference represented by f [Hz], a nip width corresponding to a length in a direction in which the recording sheet is moved in the transfer nip represented by d [mm], and a surface movement velocity of the intermediate transfer member represented by V [mm/s], the following relation obtains: $f>(4/d)\times V$.

13. The image forming apparatus according to claim 7, wherein the electric potential difference generator generates the second superimposed electric potential difference having the AC component whose duty ratio in a toner returning direction in which the toner is moved from the recording sheet to the intermediate transfer member is lower than 50%.

14. The image forming apparatus according to claim 13, wherein the electric potential difference generator generates the second superimposed electric potential difference having the AC component whose duty ratio in the toner returning direction is equal to or higher than 8%.

15. The image forming apparatus according to claim 7, wherein the transfer device further comprises a facing member to contact an inner face of the intermediate transfer member to face the nip forming member via the intermediate transfer member, wherein the electric potential difference generator outputs a transfer bias to at least one of the facing member and the nip forming member to generate the electric potential difference between the intermediate transfer member and the nip forming member.

16. The image forming apparatus according to claim 15, wherein the electric potential difference generator outputs the transfer bias to the facing member.

17. An image forming apparatus, comprising:

an image forming carrier having a surface to form and bear a toner image;

an electric potential difference generator generate an electric potential difference;

a transfer member to press against the image forming carrier to form a transfer nip between the image forming carrier and the transfer member and transfer the toner image on the surface of the image forming carrier to a recording sheet clamped in the transfer nip in a state in which the electric potential difference generator generates the electric potential difference between the image forming carrier and the transfer member;

a fixing device to fix the toner image on the recording sheet after the recording sheet is passed through the transfer nip;

an inverting device to invert the recording sheet after the toner image is transferred and fixed onto a first side of the recording sheet upon passing through the transfer nip and the fixing device and to then transport the recording sheet to the transfer nip again; and a processor to cause the electric potential difference generator to generate a first electric potential difference containing only a direct current (DC) component when the toner image is transferred onto the first side of the recording sheet, and to generate a second electric potential difference containing a DC component and a superimposed alternating current (AC) component when the toner image is transferred onto a second side of the recording sheet, wherein the second electric potential difference has an averaged absolute value per unit of time smaller than an absolute value of the first electric potential difference, and wherein, with a frequency of the AC component in the second electric potential difference represented by f [Hz], a nip width corresponding to a length in a direction in which the recording sheet is moved in the transfer nip represented by d [mm], and a surface movement velocity of the image forming carrier represented by V [mm/s], the following relation obtains: $f>(4/d)\times V$.

18. The image forming apparatus according to claim 17, wherein the electric potential difference generator generates the second electric potential difference having the AC component whose duty ratio in a toner returning direction in which the toner is moved from the recording sheet to the image forming carrier is lower than 50%.

19. The image forming apparatus according to claim 18, wherein the electric potential difference generator generates the second electric potential difference having the AC component whose duty ratio in the toner returning direction is equal to or higher than 8%.

20. An image forming apparatus, comprising:

an image carrier to bear a toner image;

a nip forming member to form a transfer nip between the image carrier and the nip forming member;

a power supply to output a transfer bias to transfer the toner image from the image carrier onto a sheet at the transfer nip, a fixing device to fix the toner image on the sheet;

an inverting device to invert the sheet after the toner image is transferred and fixed onto a first side of the sheet and to then transport the sheet to the transfer nip again to transfer the toner image onto a second side of the sheet; and a controller to control the power supply to output a first bias containing only a DC component when the toner image is transferred onto the first side of the sheet and to output a second bias including an AC component when the toner image is transferred onto the second side of the sheet, wherein a level of a time-averaged value of the second bias is smaller than a level of the first bias.

21. The image forming apparatus according to claim 20, further comprising a photoconductor, wherein the image carrier is an intermediate transfer belt on which the toner image is transferred from the photoconductor, and the nip forming member is a secondary transfer roller.

22. The image forming apparatus according to claim 1, wherein a returning electrical field to return the toner image from the recording sheet side to the intermediate transfer member side and a transfer electrical field to move the toner image from the intermediate transfer member side to the recording sheet side are alternatively formed when the electric potential difference generator generates the second electric difference.

23. The image forming apparatus according to claim 20, wherein a polarity of the second bias is alternatively switched when the toner image is transferred onto the second side of the sheet.

24. The image forming apparatus according to claim 23, wherein the second bias comprises curved waveforms whose positive peak and negative peak are not symmetrical in one cycle.

* * * * *